US007032523B2

(12) United States Patent
Forslund, III et al.

(10) Patent No.: US 7,032,523 B2
(45) Date of Patent: Apr. 25, 2006

(54) WORKSTATION WITH A MOVEABLE APPARATUS

(75) Inventors: Carl V. Forslund, III, East Grand Rapids, MI (US); Joel Stanfield, Kentwood, MI (US); Jonathan J. King, East Grand Rapids, MI (US); Mark A. Baloga, East Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 384 days.

(21) Appl. No.: 10/406,166

(22) Filed: Apr. 3, 2003

(65) Prior Publication Data

US 2004/0194669 A1 Oct. 7, 2004

(51) Int. Cl.
*A47B 37/00* (2006.01)

(52) U.S. Cl. ..... 108/50.01; 312/223.3

(58) Field of Classification Search ..... 108/50.01, 108/50.02, 42; 52/36.1, 29, 732.1, 732.3; 312/223.1, 223.2, 223.3; 248/917, 920, 922, 248/923

See application file for complete search history.

(56) References Cited

U.S. PATENT DOCUMENTS

| | | | |
|---|---|---|---|
| 119,054 | A | 9/1871 | Shryock |
| 241,600 | A | 5/1881 | Bray |
| 241,925 | A | 5/1881 | Cadwell |
| 249,198 | A | 11/1881 | Moon |
| 253,538 | A | 2/1882 | McLane |
| 454,844 | A | 6/1891 | Brewerton et al. |
| 475,126 | A | 5/1892 | Lorenz |
| 549,347 | A | 11/1895 | Clark |
| 605,148 | A | 6/1898 | Sylvester |
| 621,835 | A | 3/1899 | MacDonald |
| 627,396 | A | 6/1899 | Daly |
| 713,417 | A | 11/1902 | Feldmann, Jr. et al. |
| 821,144 | A | 5/1906 | Walsh |
| 943,821 | A | 12/1909 | Feldmann, Jr. |
| 950,006 | A | 2/1910 | McCarty |
| 955,586 | A | 4/1910 | Emerich |
| 997,866 | A | 7/1911 | Smith |
| 1,086,236 | A | 2/1914 | Staples |
| 1,116,484 | A | 11/1914 | Ralph |
| 1,122,926 | A | 12/1914 | Hick |

(Continued)

FOREIGN PATENT DOCUMENTS

| | | |
|---|---|---|
| AT | 164466 | 11/1949 |

(Continued)

OTHER PUBLICATIONS

Brochure by UNIFOR titled "Panelli PL" (undated) (37 sheets).

(Continued)

*Primary Examiner*—José V. Chen
(74) *Attorney, Agent, or Firm*—Foley & Lardner LLP

(57) ABSTRACT

A workstation is disclosed that defines a work space and provides at least one display device. The workstation includes a base providing a guide. The workstation also includes at least one upstanding structure having a wheel assembly adapted for movement along a path defined by the guide about the work space to selectively deliver utilities to at least one portion of the work space and a worksurface coupled to the structure and providing a display support assembly adapted for pivotably coupling of the display device. The structure and worksurface and display support assembly are movable relative to the base so that a display device coupled to the display support assembly may be selectively positioned for use in a variety of locations in the work space.

108 Claims, 17 Drawing Sheets

U.S. PATENT DOCUMENTS

| | | | | |
|---|---|---|---|---|
| 1,141,404 | A | | 6/1915 | Moseley |
| 1,203,659 | A | | 11/1916 | Smith |
| 1,254,036 | A | | 1/1918 | Grant |
| 1,326,832 | A | | 12/1919 | Baily |
| 1,457,990 | A | | 6/1923 | Morgan |
| 1,599,888 | A | | 9/1926 | Haskell |
| 1,616,897 | A | | 2/1927 | Hayes |
| 1,688,456 | A | | 10/1928 | Dolph |
| 1,770,755 | A | | 7/1930 | Kleinpell |
| 1,826,469 | A | | 10/1931 | Hunt et al. |
| 1,881,636 | A | | 10/1932 | Johnson et al. |
| 1,887,539 | A | | 11/1932 | Brown |
| 1,943,629 | A | | 1/1934 | Schwartz |
| 1,958,579 | A | | 5/1934 | Johnson et al. |
| 1,997,829 | A | | 4/1935 | McKee |
| 2,070,408 | A | | 2/1937 | Leidgen |
| 2,144,083 | A | | 1/1939 | Rentfrow, Sr. |
| 2,182,703 | A | | 12/1939 | Rainwater |
| 2,348,414 | A | | 5/1944 | Pierce |
| 2,583,803 | A | | 1/1952 | Amer |
| 2,589,803 | A | | 3/1952 | Haley |
| 2,691,238 | A | | 10/1954 | Svatos |
| 2,713,609 | A | | 7/1955 | Niklason |
| 2,778,512 | A | | 10/1957 | Strona |
| 2,812,067 | A | | 11/1957 | Gussack |
| 2,870,459 | A | | 1/1959 | Zabielski |
| 2,886,182 | A | | 5/1959 | Dauman |
| 2,914,873 | A | | 12/1959 | Brennan |
| 2,928,555 | A | | 3/1960 | Childs et al. |
| 2,963,332 | A | | 12/1960 | Breuning |
| 2,979,155 | A | | 4/1961 | Scharfenberger |
| 3,017,999 | A | | 1/1962 | Cano |
| 3,042,978 | A | | 7/1962 | Eames et al. |
| 3,060,521 | A | | 10/1962 | Greco |
| 3,078,133 | A | | 2/1963 | Schauer |
| 3,141,207 | A | | 7/1964 | Kahler |
| 3,181,274 | A | | 5/1965 | Izenour |
| 3,251,477 | A | | 5/1966 | Parstorfer |
| 3,286,382 | A | | 11/1966 | Newman |
| 3,351,211 | A | | 11/1967 | Best |
| 3,391,796 | A | | 7/1968 | Cross |
| 3,412,868 | A | | 11/1968 | Carter |
| 3,425,568 | A | | 2/1969 | Albright |
| 3,514,883 | A | | 6/1970 | Albright |
| 3,557,499 | A | | 1/1971 | Dickie et al. |
| 3,581,423 | A | | 6/1971 | Mascolo |
| 3,683,100 | A | | 8/1972 | Deal et al. |
| 3,732,633 | A | | 5/1973 | Margolis et al. |
| 3,760,952 | A | | 9/1973 | White |
| 3,777,896 | A | | 12/1973 | Ehrlich |
| 3,797,146 | A | | 3/1974 | Holes |
| 3,857,731 | A | | 12/1974 | Merrill, Jr. et al. |
| 3,883,972 | A | | 5/1975 | Propst et al. |
| 3,921,320 | A | | 11/1975 | McWilliams |
| 3,924,749 | A | | 12/1975 | Weston |
| 3,952,133 | A | | 4/1976 | Amos et al. |
| 3,955,788 | A | | 5/1976 | Delage |
| 3,975,837 | A | | 8/1976 | Baars |
| 3,984,930 | A | | 10/1976 | Booland |
| 4,033,058 | A | | 7/1977 | Lyman |
| 4,135,775 | A | | 1/1979 | Driscoll |
| 4,166,332 | A | | 9/1979 | Donovan |
| 4,180,298 | A | | 12/1979 | Borgerson, Jr. |
| 4,194,313 | A | | 3/1980 | Downing |
| 4,239,170 | A | | 12/1980 | Planebo |
| 4,270,290 | A | | 6/1981 | Eckert |
| 4,310,978 | A | | 1/1982 | Stern |
| 4,323,291 | A | | 4/1982 | Ball |
| 4,360,240 | A | | 11/1982 | Koncelik et al. |
| 4,360,991 | A | | 11/1982 | West |
| 4,428,136 | A | | 1/1984 | Franklin |
| 4,447,973 | A | | 5/1984 | Wihlke |
| 4,457,436 | A | | 7/1984 | Kelley |
| 4,478,467 | A | | 10/1984 | Tyndall |
| 4,561,619 | A | | 12/1985 | Robillard et al. |
| 4,569,448 | A | | 2/1986 | Graham |
| 4,588,190 | A | | 5/1986 | Stewart et al. |
| 4,606,394 | A | | 8/1986 | Bannister |
| 4,620,635 | A | | 11/1986 | Morand |
| 4,635,417 | A | | 1/1987 | Larouche |
| 4,637,666 | A | | 1/1987 | Worrell et al. |
| 4,652,239 | A | | 3/1987 | Brimberg |
| 4,658,966 | A | | 4/1987 | Broek |
| 4,659,048 | A | | 4/1987 | Fahrion |
| 4,712,842 | A | * | 12/1987 | Price et al. ..... 312/223.3 |
| 4,715,154 | A | | 12/1987 | Baloga |
| 4,716,698 | A | | 1/1988 | Wilson et al. |
| 4,723,665 | A | | 2/1988 | Benedict et al. |
| 4,723,821 | A | | 2/1988 | Montgomery |
| 4,732,089 | A | | 3/1988 | Mueller |
| 4,750,305 | A | | 6/1988 | Bastian |
| 4,757,901 | A | | 7/1988 | Woods |
| 4,766,422 | A | * | 8/1988 | Wolters et al. ..... 312/223.3 |
| 4,771,557 | A | | 9/1988 | Bowman |
| 4,793,495 | A | | 12/1988 | Preu |
| 4,805,331 | A | | 2/1989 | Boggess et al. |
| 4,852,500 | A | | 8/1989 | Ryburg et al. |
| 4,902,229 | A | | 2/1990 | Pedersen et al. |
| 4,913,297 | A | | 4/1990 | Wells |
| 4,928,465 | A | | 5/1990 | De Castillo von Haucke |
| 4,932,172 | A | | 6/1990 | Maas |
| 4,954,382 | A | | 9/1990 | Riefler et al. |
| 4,979,785 | A | | 12/1990 | Richards |
| 4,986,194 | A | | 1/1991 | Bollman |
| 4,996,110 | A | | 2/1991 | Tanuma et al. |
| 5,016,373 | A | | 5/1991 | Theno |
| 5,025,603 | A | | 6/1991 | Johnson |
| 5,090,171 | A | | 2/1992 | Kano et al. |
| 5,105,952 | A | | 4/1992 | Krattiger |
| 5,108,063 | A | | 4/1992 | Koerber, Sr. et al. |
| 5,109,994 | A | | 5/1992 | Kidd et al. |
| 5,112,020 | A | | 5/1992 | Ginsberg |
| 5,125,202 | A | | 6/1992 | Kissinger |
| 5,139,155 | A | | 8/1992 | Laxson |
| 5,148,925 | A | | 9/1992 | Althoff et al. |
| 5,160,050 | A | | 11/1992 | Russo |
| 5,160,189 | A | | 11/1992 | Johnston et al. |
| 5,161,321 | A | | 11/1992 | Kuhnke |
| 5,181,334 | A | | 1/1993 | Mima |
| 5,186,499 | A | | 2/1993 | Mason |
| 5,214,885 | A | | 6/1993 | Maas et al. |
| 5,226,548 | A | | 7/1993 | Koeppel |
| 5,241,796 | A | | 9/1993 | Hellwig et al. |
| 5,248,536 | A | | 9/1993 | DuKatz |
| 5,277,007 | A | | 1/1994 | Hellwig et al. |
| 5,282,341 | A | | 2/1994 | Baloga et al. |
| 5,289,926 | A | | 3/1994 | Lewis et al. |
| 5,290,002 | A | | 3/1994 | Cohen |
| 5,301,477 | A | | 4/1994 | Rellinger et al. |
| 5,309,686 | A | | 5/1994 | Underwood et al. |
| 5,321,579 | A | | 6/1994 | Brown et al. |
| 5,342,665 | A | | 8/1994 | Krawitz |
| 5,368,486 | A | | 11/1994 | Kurzman |
| 5,375,802 | A | | 12/1994 | Branham, II |
| 5,379,977 | A | | 1/1995 | Rönn et al. |
| 5,384,999 | A | | 1/1995 | Roche et al. |
| 5,392,934 | A | | 2/1995 | Fox |
| 5,394,631 | A | | 3/1995 | Bosio |
| 5,405,117 | A | | 4/1995 | Davis |
| 5,406,761 | A | | 4/1995 | Hobbiebrunken et al. |
| 5,422,155 | A | | 6/1995 | Spence, Jr. |
| 5,428,928 | A | | 7/1995 | Hellwig et al. |
| 5,486,391 | A | | 1/1996 | Tyner |
| 5,495,953 | A | | 3/1996 | Bearth |

| | | | | |
|---|---|---|---|---|
| 5,503,278 | A | 4/1996 | Ishmael | |
| 5,511,348 | A | 4/1996 | Cornell et al. | |
| 5,513,574 | A | 5/1996 | Collins | |
| 5,534,963 | A | 7/1996 | Adolphi et al. | |
| 5,536,080 | A | 7/1996 | Madimenos et al. | |
| 5,537,290 | A | 7/1996 | Brown et al. | |
| 5,549,267 | A | 8/1996 | Armbruster et al. | |
| 5,558,418 | A | 9/1996 | Lambright et al. | |
| 5,569,503 | A | 10/1996 | Piotroski | |
| 5,584,546 | A | 12/1996 | Gurin et al. | |
| 5,588,659 | A | 12/1996 | Boes et al. | |
| 5,590,940 | A | 1/1997 | Richard | |
| 5,607,214 | A | 3/1997 | Pierce et al. | |
| 5,609,112 | A | 3/1997 | Meyer et al. | |
| 5,617,660 | A | 4/1997 | Pollack | |
| 5,635,265 | A | 6/1997 | Potokar | |
| 5,647,172 | A | 7/1997 | Rokicki | |
| 5,649,631 | A | 7/1997 | Loflin | |
| 5,651,219 | A | 7/1997 | Baloga et al. | |
| 5,655,323 | A | 8/1997 | Lassoff | |
| 5,655,672 | A | 8/1997 | Stuchlik, III | |
| 5,658,635 | A | 8/1997 | Davis et al. | |
| 5,669,518 | A | 9/1997 | Kundel | |
| 5,675,946 | A | 10/1997 | Verbeek et al. | |
| 5,687,499 | A | 11/1997 | Brnjac | |
| 5,687,513 | A | 11/1997 | Baloga et al. | |
| 5,688,579 | A | 11/1997 | Konsti et al. | |
| 5,694,881 | A | 12/1997 | Creech | |
| 5,695,264 | A | 12/1997 | Koch | |
| 5,697,589 | A | 12/1997 | Garfinkle | |
| 5,711,121 | A | 1/1998 | Garver | |
| D390,967 | S | 2/1998 | Beuster et al. | |
| 5,724,778 | A | 3/1998 | Cornell et al. | |
| 5,743,193 | A | 4/1998 | Kakuta et al. | |
| 5,746,330 | A | 5/1998 | DiBetta | |
| 5,765,315 | A | 6/1998 | Nagamitsu et al. | |
| 5,771,954 | A | 6/1998 | Benner et al. | |
| 5,794,392 | A | 8/1998 | Forslund, III et al. | |
| 5,826,385 | A | 10/1998 | Dykstra et al. | |
| 5,826,639 | A | 10/1998 | Miller | |
| 5,829,202 | A | 11/1998 | Canton Gongora et al. | |
| 5,831,211 | A | 11/1998 | Gartung et al. | |
| 5,848,698 | A | 12/1998 | Stompe | |
| 5,873,205 | A | 2/1999 | Hanlon et al. | |
| 5,901,513 | A | 5/1999 | Mollenkopf et al. | |
| 5,904,328 | A | 5/1999 | Leveridge et al. | |
| 5,913,787 | A | 6/1999 | Edwards | |
| 5,931,429 | A | 8/1999 | Hellwig et al. | |
| 5,941,713 | A | 8/1999 | Wayner et al. | |
| 5,952,796 | A | 9/1999 | Colgate et al. | |
| 5,966,879 | A | 10/1999 | Verbeek et al. | |
| 5,974,985 | A * | 11/1999 | Flototto et al. | 108/50.01 |
| 5,984,441 | A | 11/1999 | Stokhuijzen | |
| 6,048,044 | A | 4/2000 | Biggel et al. | |
| 6,076,317 | A | 6/2000 | Hellwig et al. | |
| 6,076,903 | A | 6/2000 | Vander Park | |
| 6,099,093 | A | 8/2000 | Spence | |
| 6,244,991 | B1 | 6/2001 | Bingham | |
| 6,249,999 | B1 | 6/2001 | Börge et al. | |
| 6,250,019 | B1 | 6/2001 | Simons, Jr. et al. | |
| 6,253,509 | B1 | 7/2001 | Hellwig et al. | |
| 6,263,602 | B1 | 7/2001 | Seiber et al. | |
| 6,272,779 | B1 | 8/2001 | Seiber et al. | |
| 6,275,375 | B1 | 8/2001 | Nam | |
| 6,279,761 | B1 | 8/2001 | Niewiadomski et al. | |
| 6,317,316 | B1 | 11/2001 | Bentley et al. | |
| 6,343,006 | B1 | 1/2002 | Moscovitch et al. | |
| 6,344,610 | B1 | 2/2002 | Berndt | |
| 6,374,547 | B1 | 4/2002 | Baloga et al. | |
| 6,374,548 | B1 | 4/2002 | Ruedinger et al. | |
| 6,409,134 | B1 | 6/2002 | Oddsen, Jr. | |
| 6,415,553 | B1 | 7/2002 | Krayer, Jr. et al. | |
| 6,449,909 | B1 | 9/2002 | Baloga et al. | |
| 6,463,701 | B1 | 10/2002 | Baloga et al. | |
| 6,540,094 | B1 | 4/2003 | Baloga et al. | |
| 6,647,652 | B1 | 11/2003 | Seiber et al. | |
| 6,663,267 | B1 | 12/2003 | Newhouse et al. | |
| 6,681,529 | B1 | 1/2004 | Baloga et al. | |
| 6,712,008 | B1 * | 3/2004 | Habenicht et al. | 108/50.01 |
| 6,739,096 | B1 | 5/2004 | Feldpausch et al. | |
| 6,802,264 | B1 * | 10/2004 | Kasak et al. | 108/50.01 |
| 6,895,869 | B1 * | 5/2005 | Lai | 108/50.02 |
| 2002/0191400 | A1 | 12/2002 | Jilk et al. | |
| 2002/0194791 | A1 | 12/2002 | Baloga et al. | |
| 2003/0126778 | A1 | 7/2003 | Arko et al. | |

FOREIGN PATENT DOCUMENTS

| | | |
|---|---|---|
| AT | 232680 | 3/1964 |
| DE | 1 561 580 | 4/1970 |
| DE | 31 32 015 | 10/1982 |
| GB | 124334 | 3/1919 |
| GB | 2 127 682 | 4/1984 |
| JP | 3-93944 | 4/1991 |
| JP | 3-93946 | 4/1991 |
| JP | 4-222787 | 8/1992 |
| WO | WO 95/24031 | 9/1995 |

OTHER PUBLICATIONS

Brochure by UNIFOR titled "Progetto 25.90" (undated) (19 sheets).

Promotional material (chart) by Dowing Displays of Milford, Ohio, showing display models (no date), (8 color sheets).

Promotional material for "The Office of the Future . . . ", by Tarrant Interiors—of Fort Worth, Texas, (no date), (4 sheets).

Innamorati, Francesco, "The Telematic Tree", Habitat Ufficio, bearing a designation 1991 (5 sheets).

Advertisement for "Ameriwood Oak Armoire", by Office Max, bearing a designation "Nov. 11, 1995", (1 sheet).

Gertsakis, John, "Durable Yet Future Proof", bearing a designation "© 1996, National Key Centre for Design at RMIT", from Internet site: www.cfd.rmit.edu.au/outcomes/erdnews/ERD6/HOTdesk.html on Oct. 27, 1998 (3 sheets).

Promotional materials for "A World of Possibilities, Introducing Contrada™. The Next Generation in Office Furniture.", by Trendway Corporation of Holland, Michigan, bearing a designation "© 1998" (8 sheets).

Promotional material for "Village Wall," by Tellus Furniture a Paoli Company of Orleans, Indiana, bearing a designation "© 1998 Tellus Furniture", (8 color sheets).

Yates, JoAnne, "Graphic ROI Reporting," Knowledge Management at 106, (Oct. 1998) (2 sheets).

Brochure for "TooGo New Workplace Solutions," by Egan Visual, bearing a designation "©Copyright Egan Visual 1998" (16 color sheets).

Catalog pages for "Details" a Steelcase Company, with a Mar. 2001 indication, "© 2001 Office Details Inc." (6 color sheets).

M.A. Baloga, C.V. Forslund III et al., Compilation titled "Bluespace" dated Aug. 29, 2000 (internal document proprietary to Steelcase Inc.).

U.S. Appl. No. 09/571,521, titled "Information Display System" as filed May 16, 2000, including specification, claims, drawings and abstract (103 sheets) Preliminary Amendment filed May 16, 2000 (19 sheets).

U.S. Appl. No. 10/026,964, titled "Utility Distribution System" as filed Dec. 21, 2001, including specification, claims, drawings and abstract (XXX sheets).

U.S. Appl. No. 09/669,913, titled "Display Board System" as filed Sep. 25, 2000, including specification, claims, drawings and abstract (63 sheets) and Preliminary Amendment filed Sep. 25, 2000 (8 sheets).

European Search Report for EPO No. EP 99 25 0383; Examiner A. Puhl, 2 pages.

* cited by examiner

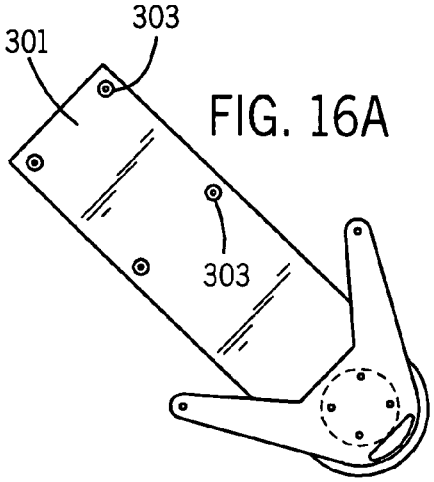
FIG. 16A
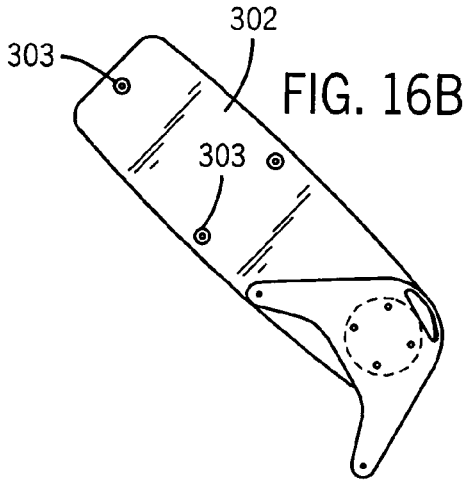
FIG. 16B
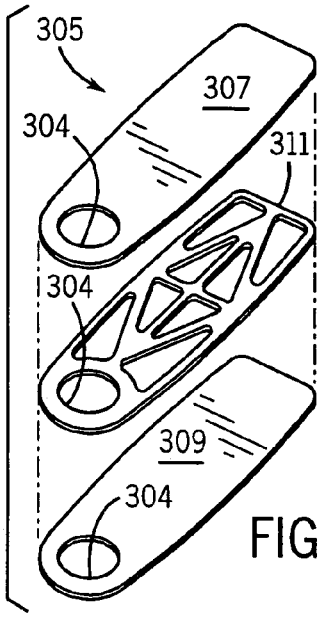
FIG. 17
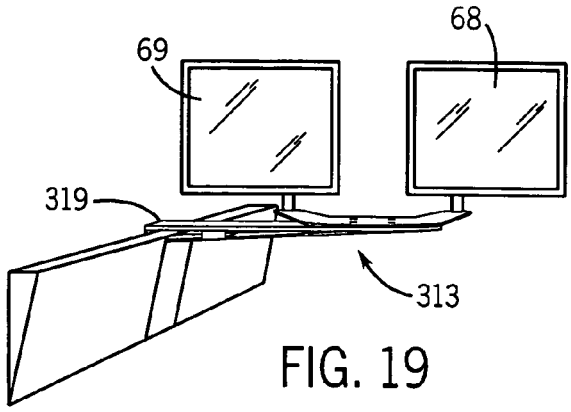
FIG. 19
FIG. 18
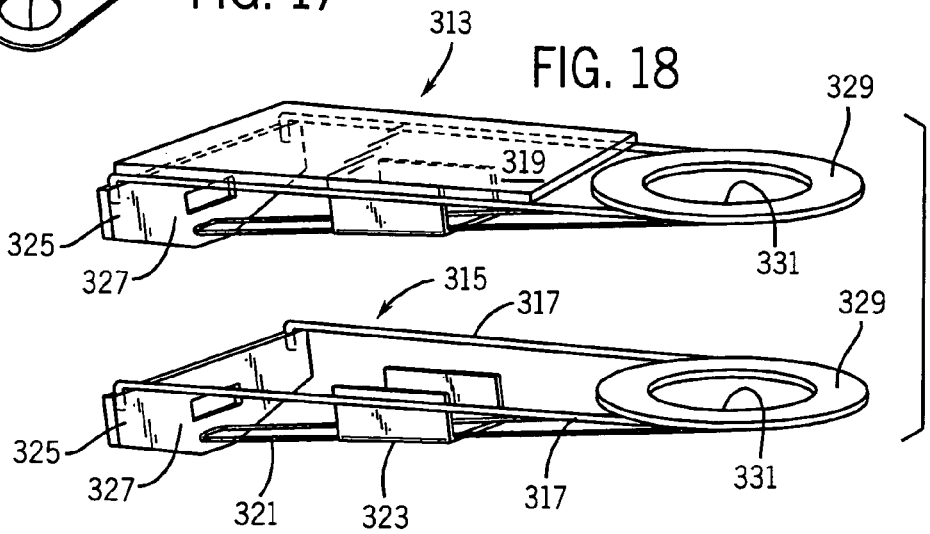

WORKSTATION WITH A MOVEABLE APPARATUS

CROSS-REFERENCE TO RELATED APPLICATIONS

The following patents and/or patent applications are hereby incorporated by reference: U.S. patent application Ser. No. 10/026,964 titled "UTILITY DISTRIBUTION SYSTEM" filed Dec. 21, 2001; U.S. patent application Ser. No. 09/887,519 titled "MOVABLE DISPLAY SUPPORT SYSTEM" filed Jun. 22, 2001; U.S. patent application Ser. No. 09/888,069 titled "MOVABLE OFFICE SUPPORT SYSTEM" filed Jun. 22, 2001; U.S. patent application Ser. No. 09/183,023 titled "WORKSTATION" filed Oct. 30, 1998, now U.S. Pat. No. 6,374,547.

FIELD

The present invention relates to a workstation for use in an office or work environment.

BACKGROUND

It is well-known to provide in an office or work environment for one or a plurality of workstations to be used by one or a plurality of workers. In such known workstations, it is well-known to provide one or more worksurfaces as well as one or more storage units (e.g. drawers, cabinets, shelves, etc.). A typical workstation may include other devices or apparatus that facilitate the work of the worker (e.g. the use and communication of information), such as computing devices, task or other lighting, telephony, as well as connections for utilities (e.g. power, voice, data, etc.).

It is also known to provide a "threshold" (or "utility threshold") having a generally vertical base frame and a generally vertical overhead top portion for use within a workstation, for example, as shown in U.S. Pat. No. 6,374,547. According to such known arrangements, the threshold is movable within the workstation along a path of travel so that it may be used to "divide" the work space and/or to provide privacy for the work of one or more workers within the workstation; the movable threshold may also be configured to deliver utilities within the workstation.

It is further known to provide for a worksurface that is movable within a workspace, so that one or more workers or other persons (who may need to work or collaborate in a wide variety of conditions) may place the worksurface in a position that is more beneficial for a particular purpose. According to certain known arrangements, the movable worksurface may be provided with one or more information display devices (e.g. panel displays or monitors of the type associated with a computing device such as a personal computer), for example, as shown in U.S. patent application Ser. No. 09/887,519.

It is also known to provide for a mobile worksurface, such as a mobile table, in a work space. In a common application, the mobile worksurface (alone or in conjunction with fixed worksurfaces), enhances the utility of a work space by providing greater flexibility and a greater range of use and other conditions. However, mobile worksurfaces—whether in use or not in use—typically require at least a portion of the work space, and at times may prove to be obstacles to occupants of the work space. The range of motion typically provided by such mobile worksurfaces is limited, for example to a particular plane or path of travel. In addition, mobile worksurfaces, typically provided with wheels or otherwise coupled to a fixed mounting structure, tend to lack the stability, size or "structure" typically provided with fixed worksurfaces. Moreover, mobile worksurfaces tend not to readily accommodate computing devices and/or display devices or other appliances and their associated cables (e.g. for power and/or data).

Accordingly, it would be advantageous to provide for a workstation providing for an apparatus such as a threshold and/or worksurface that is conveniently movable from one position to another position. It would also be advantageous to provide for an apparatus such as a threshold and/or worksurface that provides a range of movement to cover a substantial portion of the work space within the workstation. It would further be advantageous to provide for a support system for an apparatus such as a threshold and/or worksurface that allows for movement within a horizontal plane or other paths of travel within the workstation. It would also be advantageous to provide for an apparatus such as a threshold and/or worksurface movable within a workstation that conveniently allows for association with a display device and thereby for convenient repositioning of the display device within a work space. It would also be advantageous to provide an apparatus such as a threshold and/or worksurface that conveniently provides for a wide range of motion and allows for a variety of orientations. It would further be advantageous to provide for an apparatus that conveniently provides for management and interconnection of cables providing utilities to the appliances or equipment on a worksurface or to a display device (or display devices) and/or associated with a threshold. It would further be advantageous to provide for an apparatus that can readily be integrated with the articles of furniture within a workstation.

It would be desirable to provide a workstation having any one or more of these or other advantageous features.

SUMMARY

The present invention relates to a workstation defining a work space and providing at least one display device. The workstation includes a base providing a guide. The workstation also includes at least one upstanding structure having a wheel assembly adapted for movement along a path defined by the guide about the work space to selectively deliver utilities to at least one portion of the work space and a worksurface coupled to the structure and providing a display support assembly adapted for pivotably coupling of the display device. The structure and worksurface and display support assembly are movable relative to the base so that a display device coupled to the display support assembly may be selectively positioned for use in a variety of locations in the work space.

The present invention also relates to a workstation for a work space having a floor and of a type providing a computing device with at least one display device and at least one lighting device for within the work space. The workstation includes a base providing at least one track system. The workstation also includes a movable apparatus coupled to the at least one track system and movable relative to the base. The movable apparatus includes a threshold and a worksurface so that the computing device and at least one display device can be supported by the worksurface and the at least one lighting device can be provided on the threshold. The movable apparatus can be selectively positioned for use in a variety of locations along the track system.

The present invention further relates to a workstation for a work space of a type providing a computing device with at least one display device and at least one lighting device for use within the work space and connectivity to utilities such as power or voice or data. The workstation includes a base providing at least one track system. The workstation also includes a movable apparatus coupled to the at least one track system. The movable apparatus is movable relative to the base and provides support for at least one of the computing device and at least one display device or at least one lighting device. The movable apparatus can be selectively positioned for use in a variety of locations along the track system.

The present invention also relates to a workstation for a work space of a type providing a computing device with at least one display device and at least one lighting device for use within the work space and connectivity to utilities such as power or voice or data. The workstation includes a base having a front and a top. The workstation also includes a track system that includes a first guide positioned at the front of the base. The workstation further includes a movable apparatus providing support for at least one of the computing device or at least one lighting device. The movable apparatus is coupled to the track system and is movable along the first guide at the front of the base so that the movable apparatus can be selectively positioned for use in a variety of locations within the work space.

FIGURES

FIGS. 16A and 16B are top plan views of worksurfaces according to alternative embodiments.

FIG. 17 is an exploded perspective view of a worksurface according to an alternative embodiment.

FIG. 18 is a perspective view of a movable worksurface according to an alternative embodiment.

FIG. 19 is a perspective view of a wall-supported movable worksurface.

DESCRIPTION OF EXEMPLARY EMBODIMENTS

Figure 1:
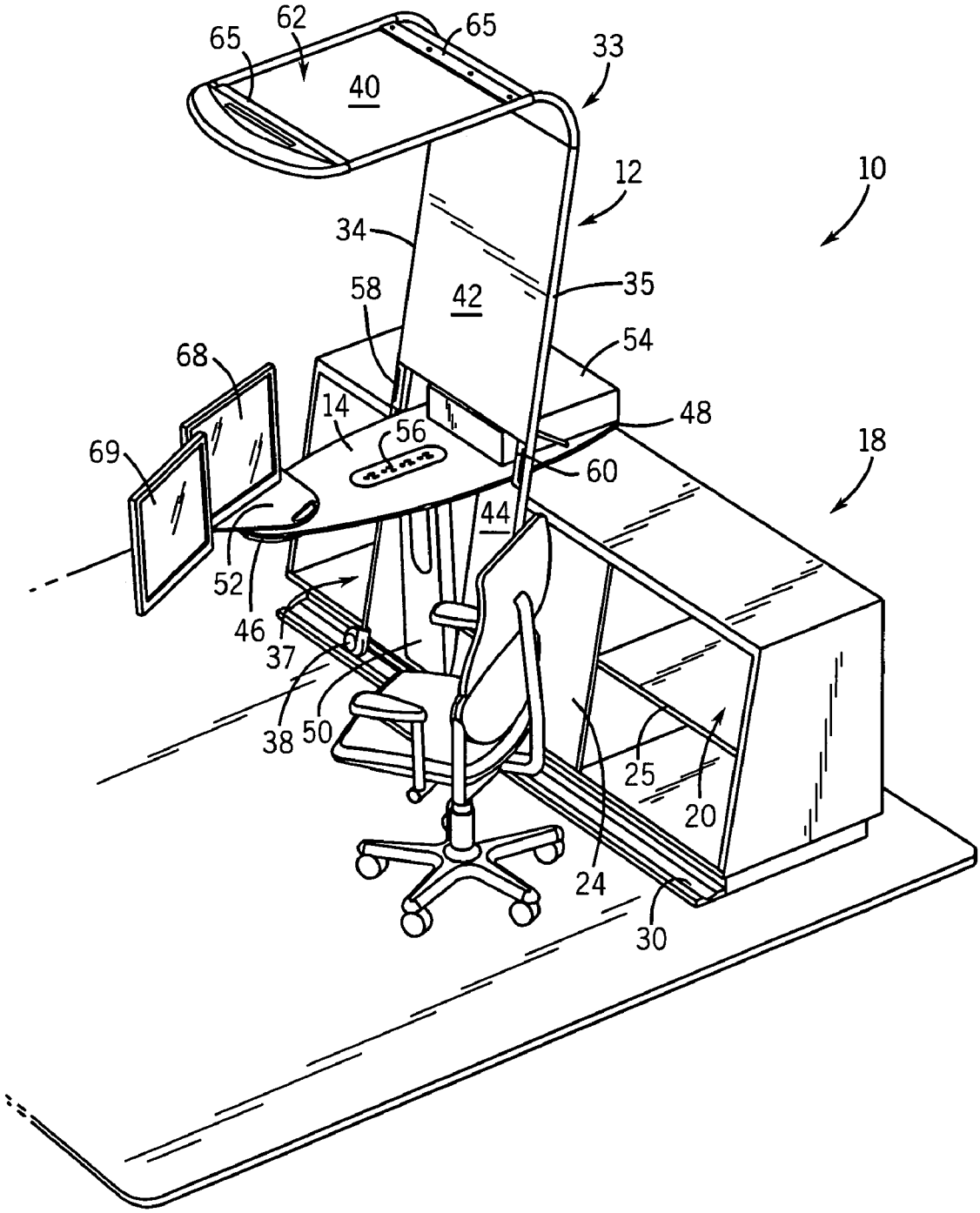
FIG. 1 is a perspective view of the workstation according to an exemplary embodiment.

Referring to FIGS. 1 through 5, a workstation 10 is shown according to various exemplary embodiments. According to the exemplary embodiments, workstation 10 may include a movable apparatus in the form of a movable threshold 12 with a worksurface 14 (as shown in FIG. 1) or simply a movable worksurface 214*a* or 214*b* (shown in FIGS. 14A–14B). According to alternative embodiments, the workstation may provide other forms of movable apparatus (e.g. a threshold with or without a worksurface). According to any preferred embodiment, the threshold and/or the worksurface are configured to facilitate the activities of one or more workers within the workstation (e.g. seated at chair 22 such as of a type shown in FIGS. 1 and 2), including the productive use of work tools such as appliances, computing devices or the like.

As shown in FIG. 1, workstation 10 comprises a base 18 (shown as comprising a storage unit or cabinet 20) and a generally upright element shown as threshold 12 that is movable relative to base 18; threshold 12 is movable relative to base 18 along a predefined path of travel. According to various exemplary and alternative embodiments, the base may be provided in a variety of other configurations including configurations based on other conventional articles of furniture.

Figure 3:
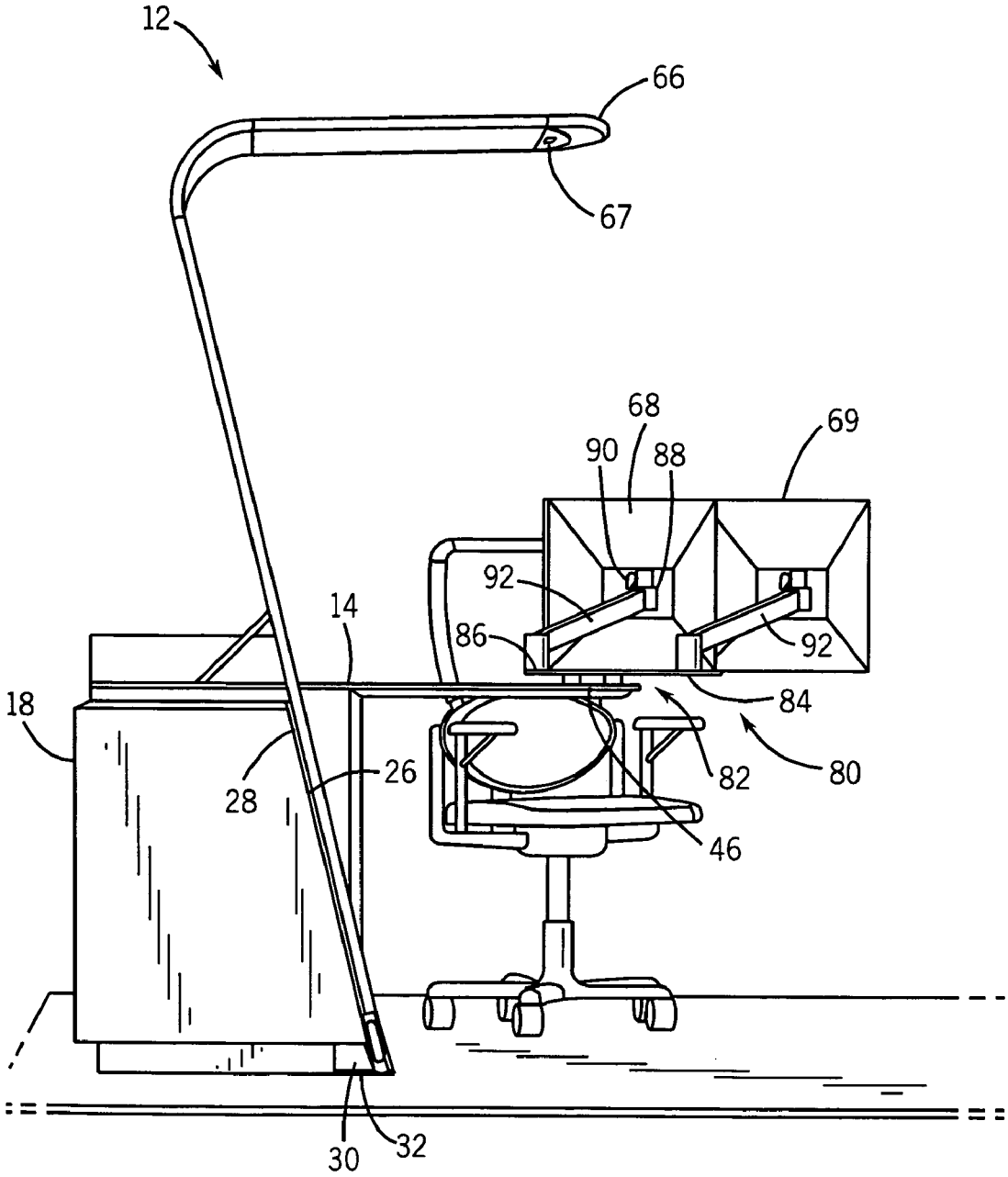
Figure 4:
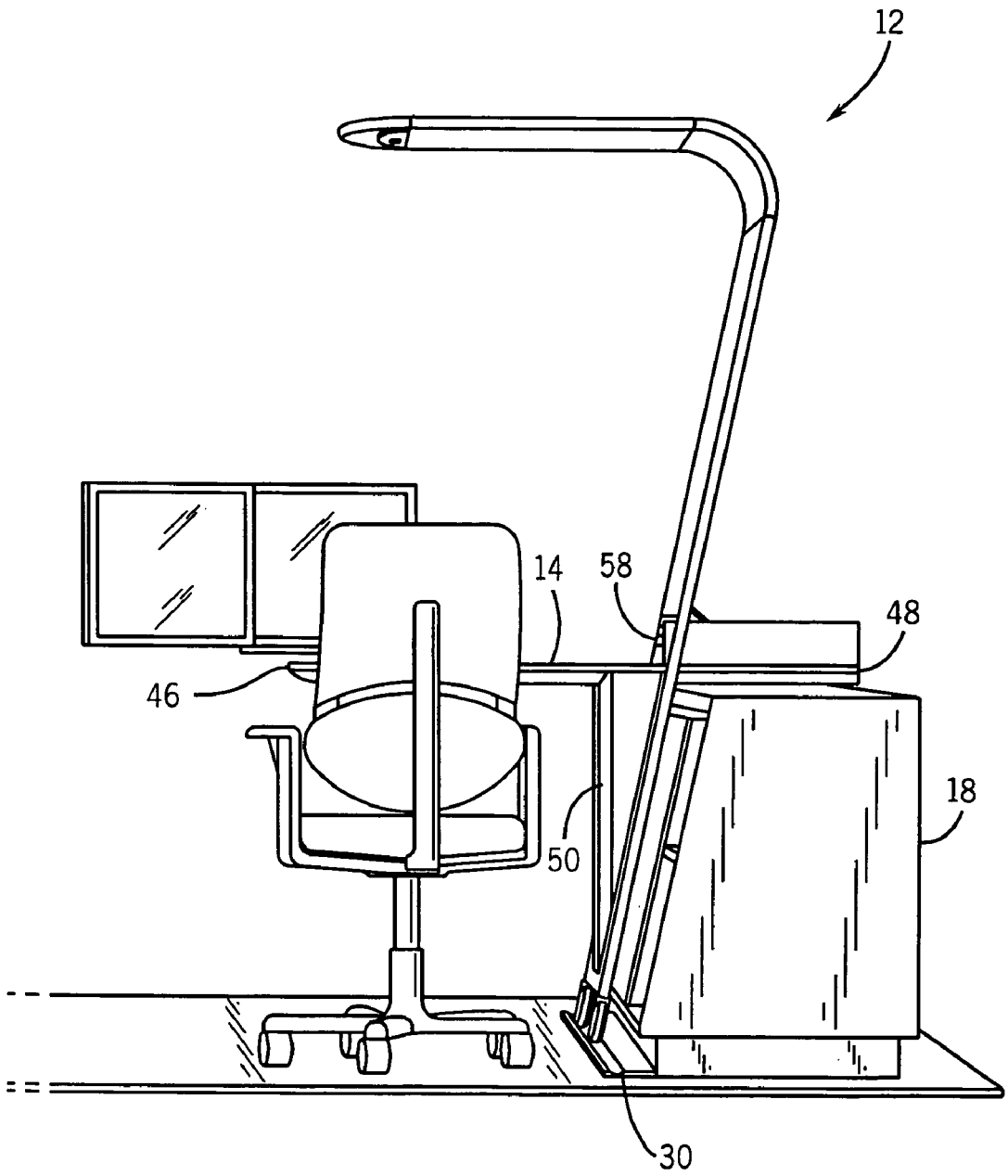
Figure 5:
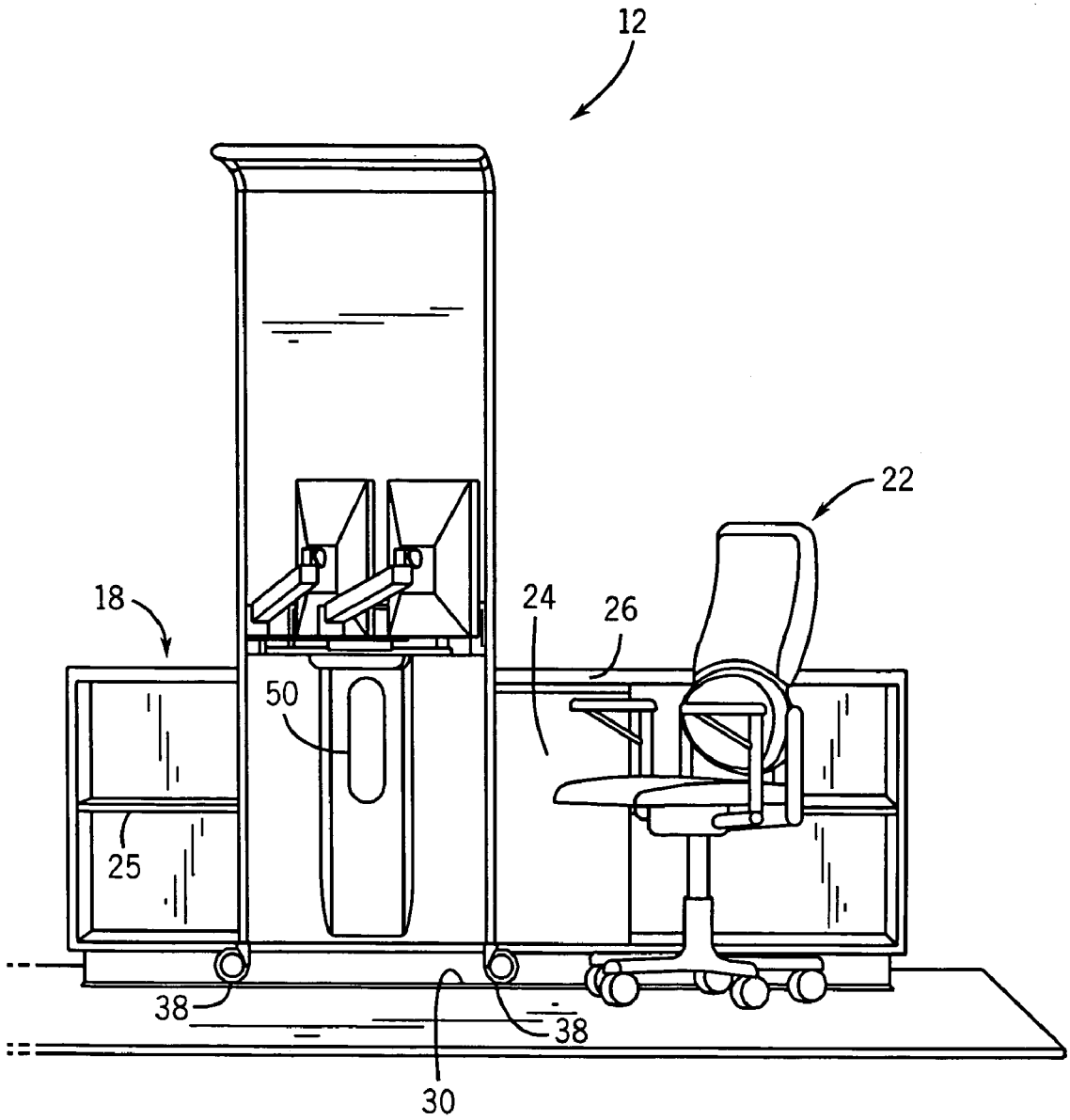
FIG. 5 is a front elevation view of the workstation of FIG. 1.

According to an exemplary embodiment, base or cabinet 18 of workstation 10 is basically of a conventional arrangement that provides a set of shelves for storage and doors (e.g. shown as cabinet 18 with sliding doors 24 and shelves 25) to facilitate or restrict access to materials stored or kept. As shown in FIG. 3, base 18 has a front surface or face 26 that is at a sloped or angular orientation relative to vertical. Face 26 of base 18 provides an upper guide 28 (or rail) and a lower guide or track shown as caster rail 30 having a rail backer or backing 32 resting upon a floor.

Threshold 12 includes a frame or structure 33 (shown as an upstanding structure) comprised of generally vertical frame members 34 and 35 (shown as structural tubes) and generally horizontal cross-members or braces 36; threshold 12 also has an overhead frame or top portion shown as canopy 62 comprised of horizontal frame members 65. Wheels shown as casters 38 are attached at a bottom portion 37 of frame 33 of threshold 12. A set of covers or panels shown as skins 40, 42 and 44 are provided within frame 33 of threshold 12. Threshold 12 also provides a worksurface 14 having a front portion 46 and a rear portion 48. Worksurface 14 is attached to threshold 12 with a mounting structure comprising gussets 50 at the lower portion of frame 33. According to a particularly preferred embodiment, front portion 46 of worksurface 14 projects from threshold 12 into the work space within workstation 10 and rear portion 48 of worksurface 14 projects in the opposite direction over base 18.

Worksurface 14 of threshold 12 provides a support 52 for a monitor or display device. Referring to FIGS. 1–5, a computing device 54 is shown resting on rear portion 48 of worksurface 14 of threshold 12. Front portion 46 of worksurface 14 of threshold 12 includes a utility access point 56 having a cover (e.g. of a type providing various outlets or ports) allowing for connections to be made to utilities (such as power or voice or data).

Figure 2:
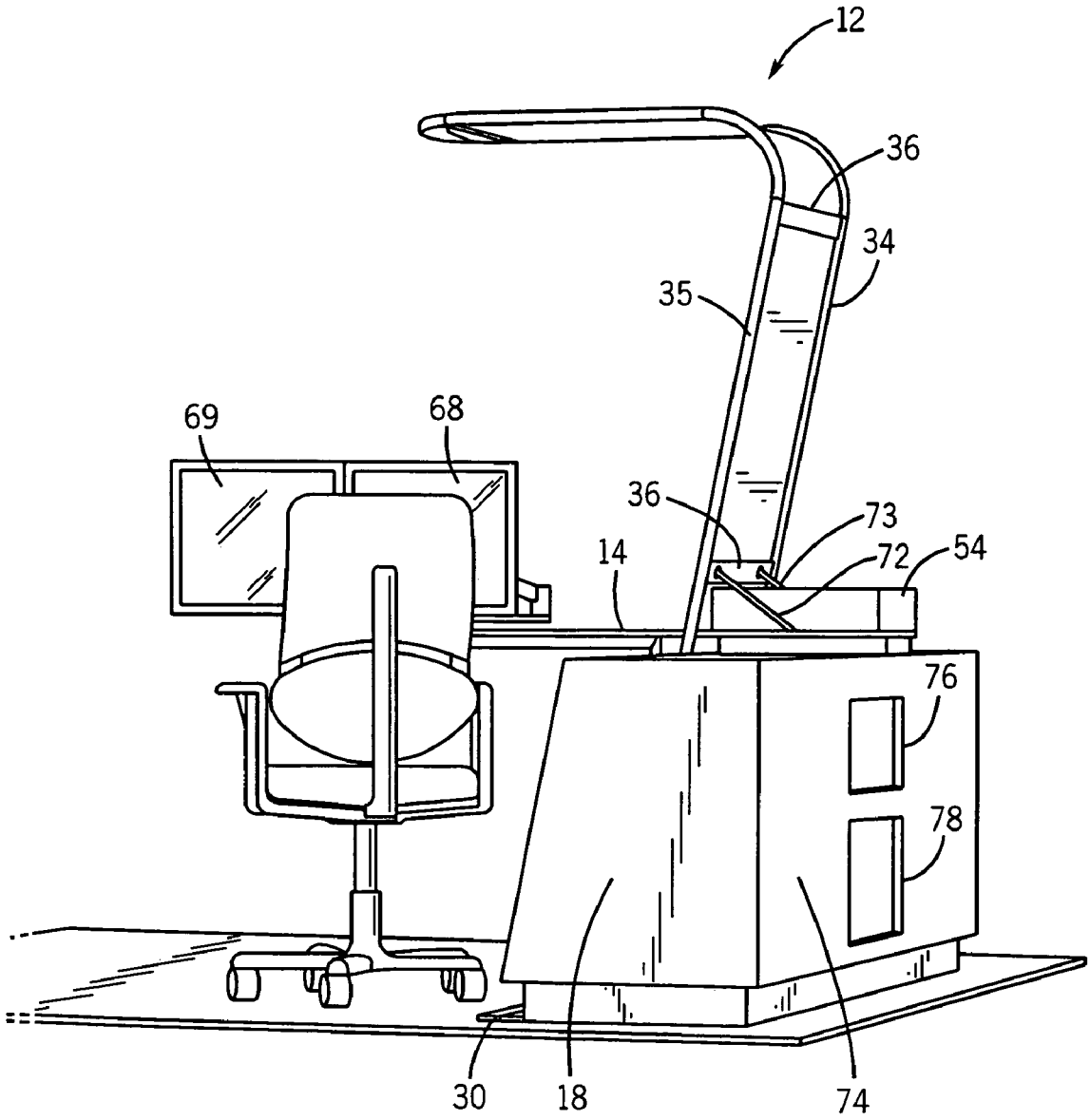
FIGS. 2 through 4 are side elevation views of the workstation shown in FIG. 1.

Also visible in FIG. 2 are structural supports of threshold 12 including frame members 34 and 35 (generally vertical) and cross-member or bracing 36. Struts 72 and 73 providing additional support for rear portion of worksurface are shown (coupled to cross-member 36). As shown in the embodiment of FIG. 2, the rear 74 of base or cabinet 18 is provided with openings or access points 76 and 78 to allow passage of utilities or other purposes into cabinet 18.

Figure 12:
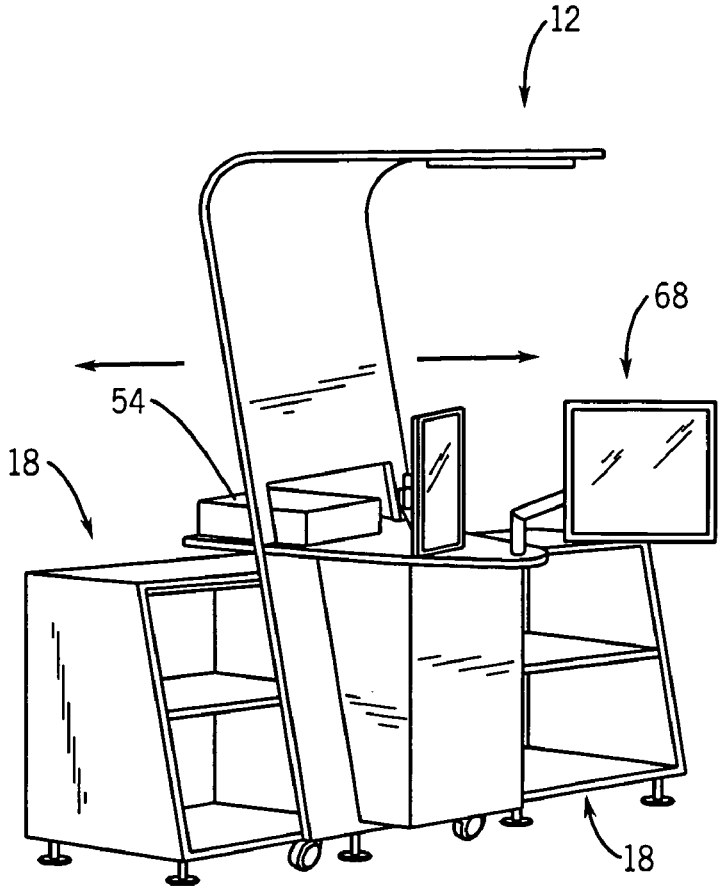
FIG. 12 is a fragmentary perspective view of the workstation showing the movable worksurface.

As generally indicated in FIG. 12, according to any preferred embodiment, the threshold is movable relative to the base (e.g. structure such as a cabinet or wall, see FIG. 1) in a path of travel generally defined by the configuration of the base or of the guide or rail (see FIG. 1).

According to a particularly preferred embodiment shown in FIG. 1, threshold 12 provides a set of grips 58 and 60 intended to facilitate convenient handling or grasping of threshold 12 so that it can be moved along its designated path of travel (defined by guide 30 in which casters 38 of threshold 12 will roll). As shown in FIGS. 1 through 4, according to an exemplary embodiment, threshold 12 rests in an angular orientation upon (e.g. bearing upon) a front guide 28 on face 26 of cabinet 18. Movement of threshold 12 may be effected by pulling or pushing threshold along guide 30 as it bears upon guide 28 of cabinet 18. Alternatively, movement of threshold 12 may be facilitated by disengaging or removing (e.g. lifting away) frame 33 of threshold 12 from contact with guide 28 and rolling threshold 12 along guide 30.

Figure 23:
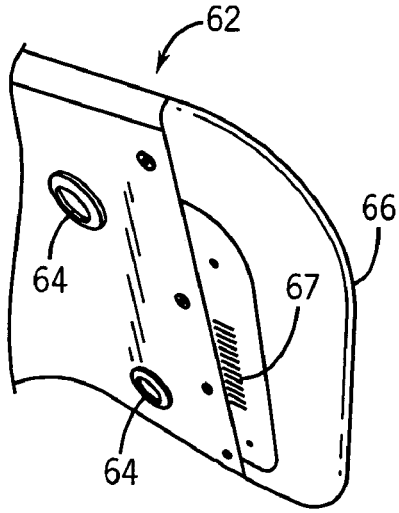
FIG. 23 is a perspective view of a canopy of a threshold within a worksurface according to an alternative embodiment.

According to any preferred embodiment, the threshold will provide an overhead beam or projection (shown as canopy 62 in FIG. 1) that generally provides a sense of space or territorial division as well as other functions at or within workstation. As shown in FIG. 23, a task light 64 may be provided with canopy 62 of threshold 12. Overhead frame or canopy 62 of threshold 12 may be provided with a housing for a signal light 66 intended to provide a signal visible to other persons within the work environment (e.g. the state or condition of the workstation and or the worker at the workstation). Canopy 62 may also be provided with a speaker shown behind grill or screen 67, a fan, or other appliances or connection to utilities, etc. A sensor 71 shown schematically in FIG. 31 may also be provided on or within the threshold for detecting at least one of lighting, temperature, humidity or sound level.

Figure 22:
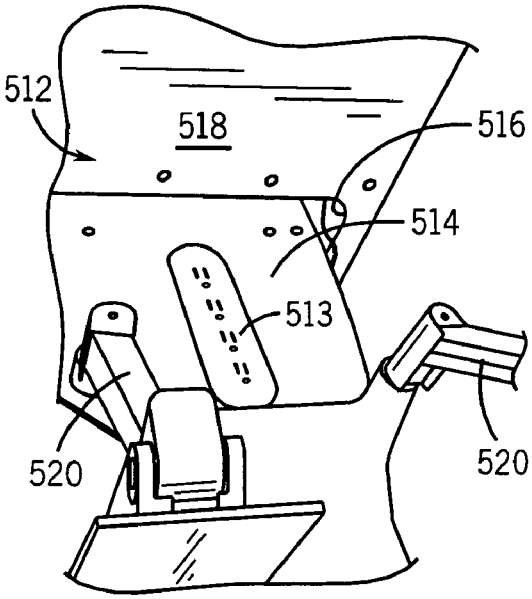
FIG. 22 is a fragmentary perspective diagram of the movable worksurface according to an alternative embodiment.
Figure 24:
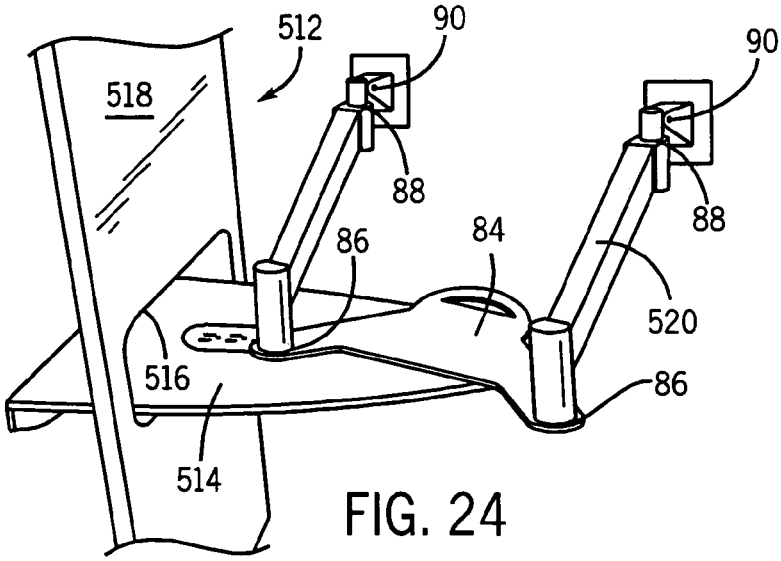
FIG. 24 is a diagram of a movable worksurface and panel arrangement for a threshold according to an alternative embodiment.

Referring still to FIG. 23, upper portion 63 of canopy 62 of threshold 12 is shown having a signaling light 66 and task lights 64 as well as an audio speaker shown behind grill or screen 67. The frame or canopy of threshold may be provided with a cover that is translucent or opaque or that otherwise is configured or sized to provide an intended effect, such as enhanced privacy or acoustic properties. As shown in FIG. 1, skins 40, 42 and 44 are of a generally translucent material (such as a fabric); according to alternative embodiments, the threshold may include generally opaque panels or other types of fabric or materials (see FIGS. 1 and 6) or may provide a generally open-frame structure. Referring to FIGS. 22 and 24, a threshold 512 (shown partially) having generally opaque panels 518 and a cutout 516 through which a worksurface 514 extends is shown.

As shown in FIGS. 1 through 5, two movable display devices 68 and 69 are coupled to worksurface 14 (e.g. at front portion 46). Referring to FIGS. 22 and 24, an exemplary embodiment of a workstation 510 is shown with a worksurface 514 having articulable arms 520 allowing for pivotal movement of display panels (not shown) are shown. Worksurface 514 is also shown having a utility access point (e.g. for power, voice, or data shown schematically as electrical outlet 513). According to alternative embodiments, the apparatus providing the movable worksurface may be provided with none, one or more than two display devices or interconnections for information displays. As shown in FIG. 15, according to an alternative embodiment, a worksurface 214*a* may be configured without any installed display devices but instead to allow the use of a portable computing device 70. As shown in FIG. 15, a worksurface of a type shown in FIG. 14A may provide a platform for a laptop computer or other portable computing device or appliance.

Referring to FIG. 3, worksurface 14 includes a movable display system 80 that provides for display panels shown as flat panel monitors 68 and 69 as well as a multi-axis articulable coupling assembly 82 to worksurface 14 shown as comprising a platform 84 and pivoting joints 86 and 88 and 90 and articulating arms 92 configured to allow movement of the display panels in a variety of orientations. Platform 84 containing displays 68 and 69 is pivotably coupled to front portion 46 of worksurface 14 and provides an upright mount or joint 86 for articulable arms 92, which pivotably couple to the housing of display panels 68 and 69 at a multi-jointed coupling. By various combinations of movement of threshold 12 and/or worksurface 14 (to which information displays may be attached) and/or articulation of one (or both) of display panels 68 and 69, the manner of presentation of information to one or more workers within workstation 10 may conveniently and selectively be enhanced or optimized.

Referring to FIGS. 6 through 10, a workstation 110 is shown according to an alternative embodiment. Workstation 110 provides a threshold 112 that is movable relative to a base or cabinet 118. Cabinet 118 provides for a worksurface shown as platform 115. Threshold 112 comprises a frame 133 and provides for a movable worksurface 114; threshold 112 is provided in a generally vertical orientation.

Figure 6:
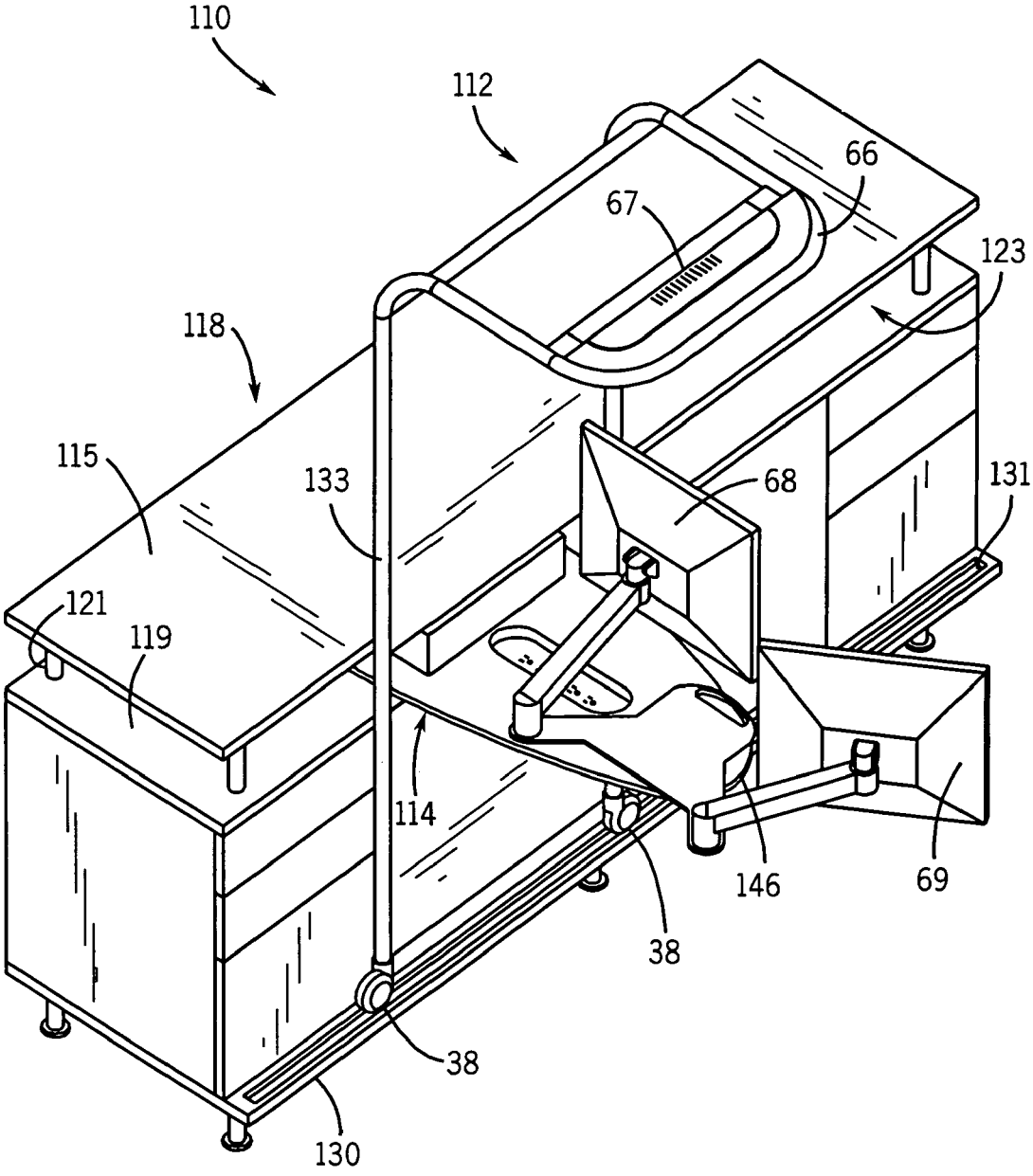
FIGS. 6 through 8 are perspective views of the workstation according to an alternative embodiment.
Figure 7:
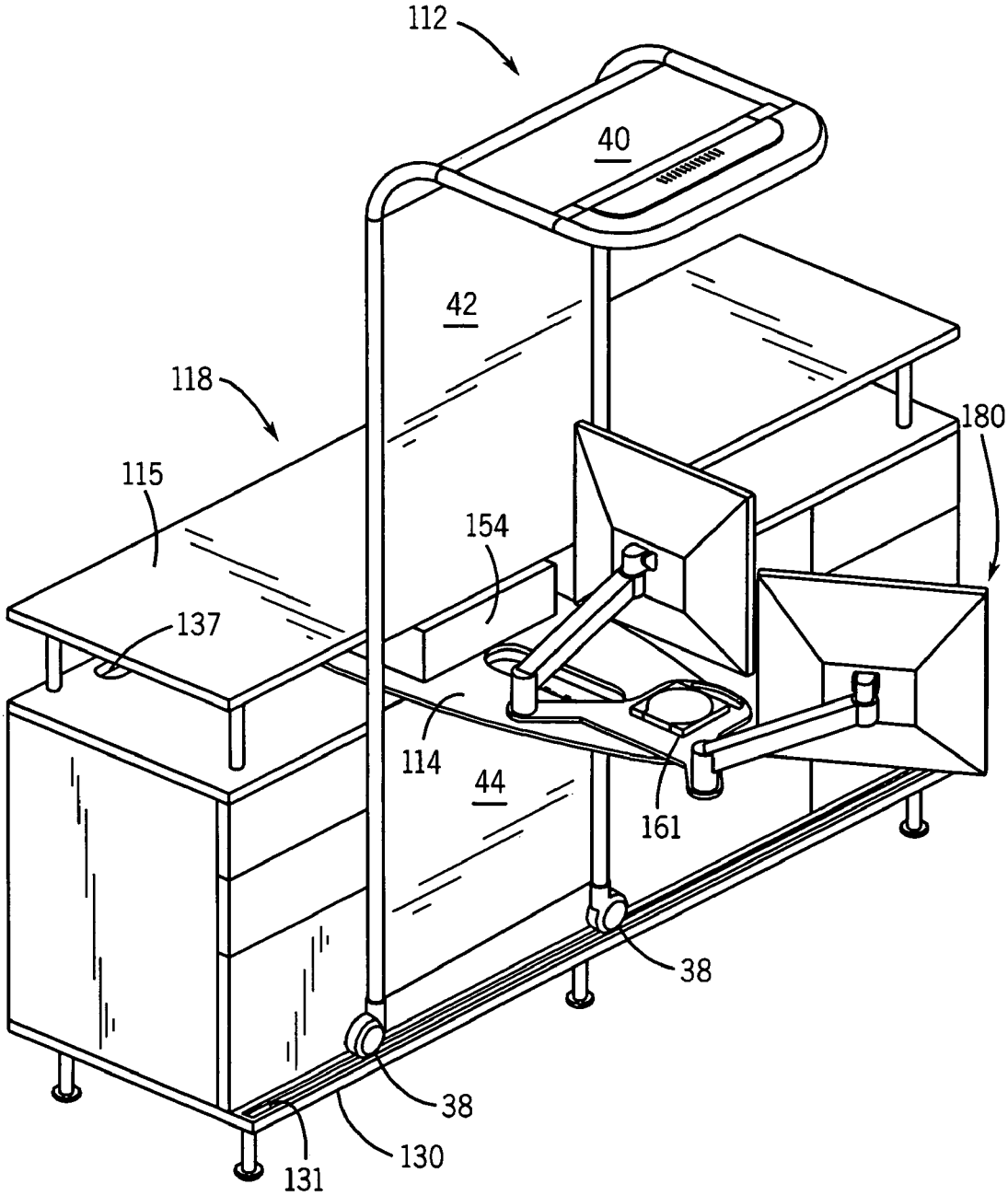

As shown in FIG. 6, threshold 112 is movable relative to base 118 along a slot or groove 131 provided in a track or guide 130 (positioned above the floor within the work space, as shown). Movement of threshold 112 relative to base 118 allows for various and/or multiple configurations of the workstation, as may be useful or beneficial to one or more workers within the workstation.

Platform 115 of base or cabinet 118 is elevated above a base surface 119 by spacers shown as vertical posts 121. Rear portion 148 of worksurface 114 of threshold 112 is fitted in a space 123 provided between platform 115 and base surface 119 of base 118. Movement of threshold 112 along track or guide 130 results in movement of worksurface 114 relative to base or cabinet 118 and movement of rear portion 148 of worksurface 114 of threshold 112 within space 123. By moving within space 123, worksurface 114 (particularly rear portion 148 of worksurface 114) does not disrupt or interfere with any articles that may be placed on platform 15.

Figure 9:
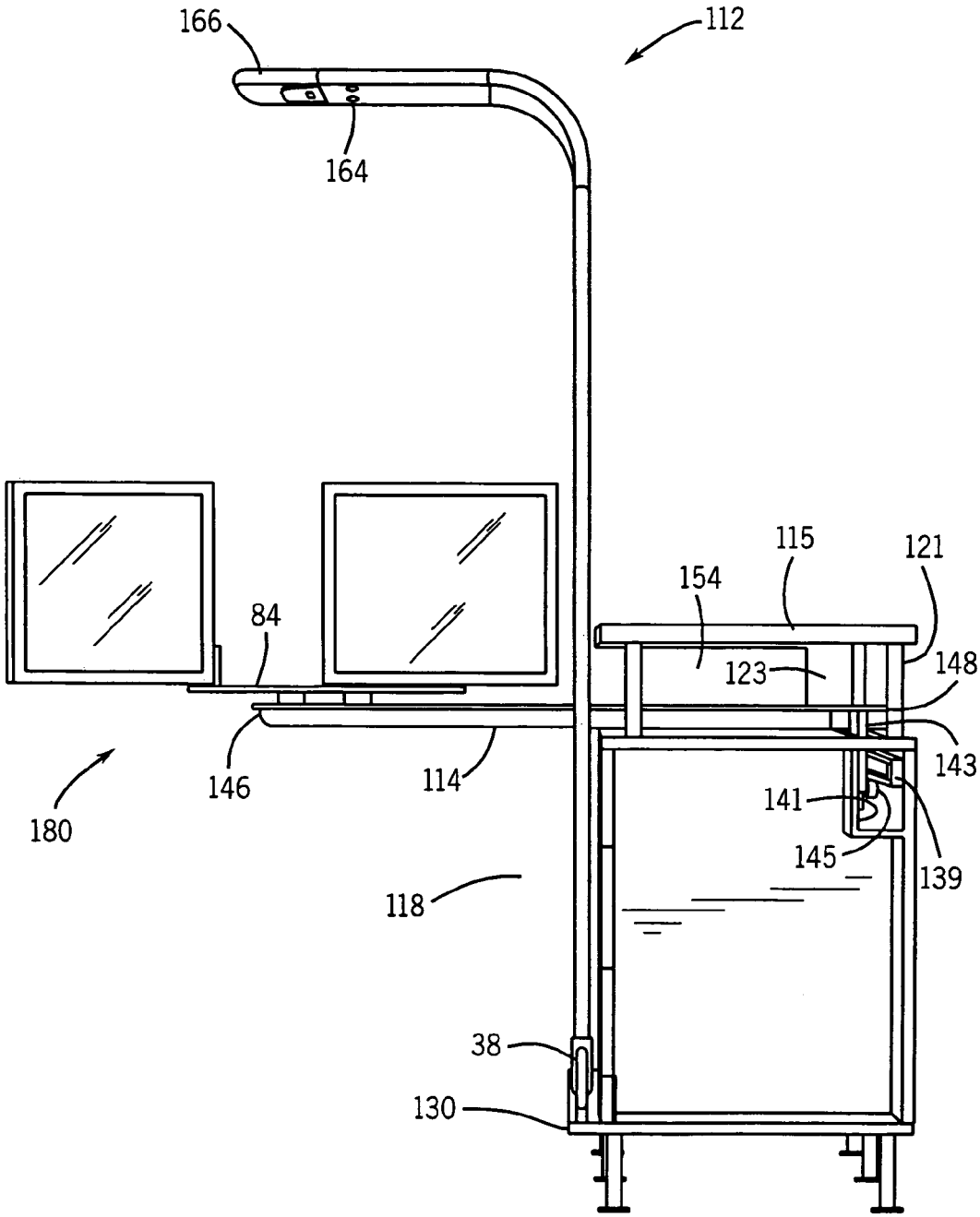
FIG. 9 is a side elevation view of the workstation shown in FIG. 7.
Figure 10:
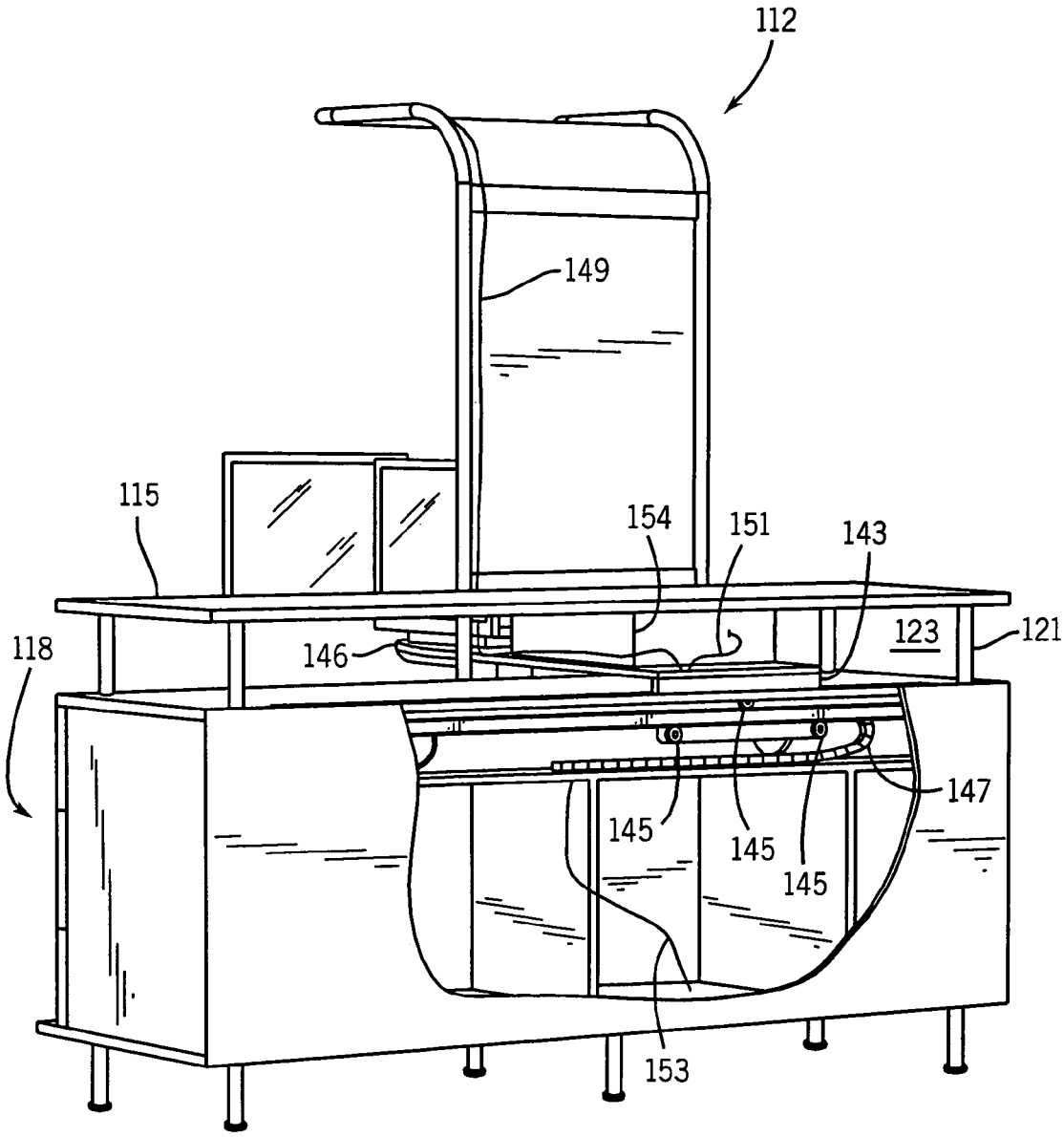
FIG. 10 is a rear perspective view of the workstation shown in FIG. 6.

As shown in FIGS. 9 and 10, space 123 is sized so that a computing device 154 may fit upon rear portion 148 of worksurface 114.

Figure 8:
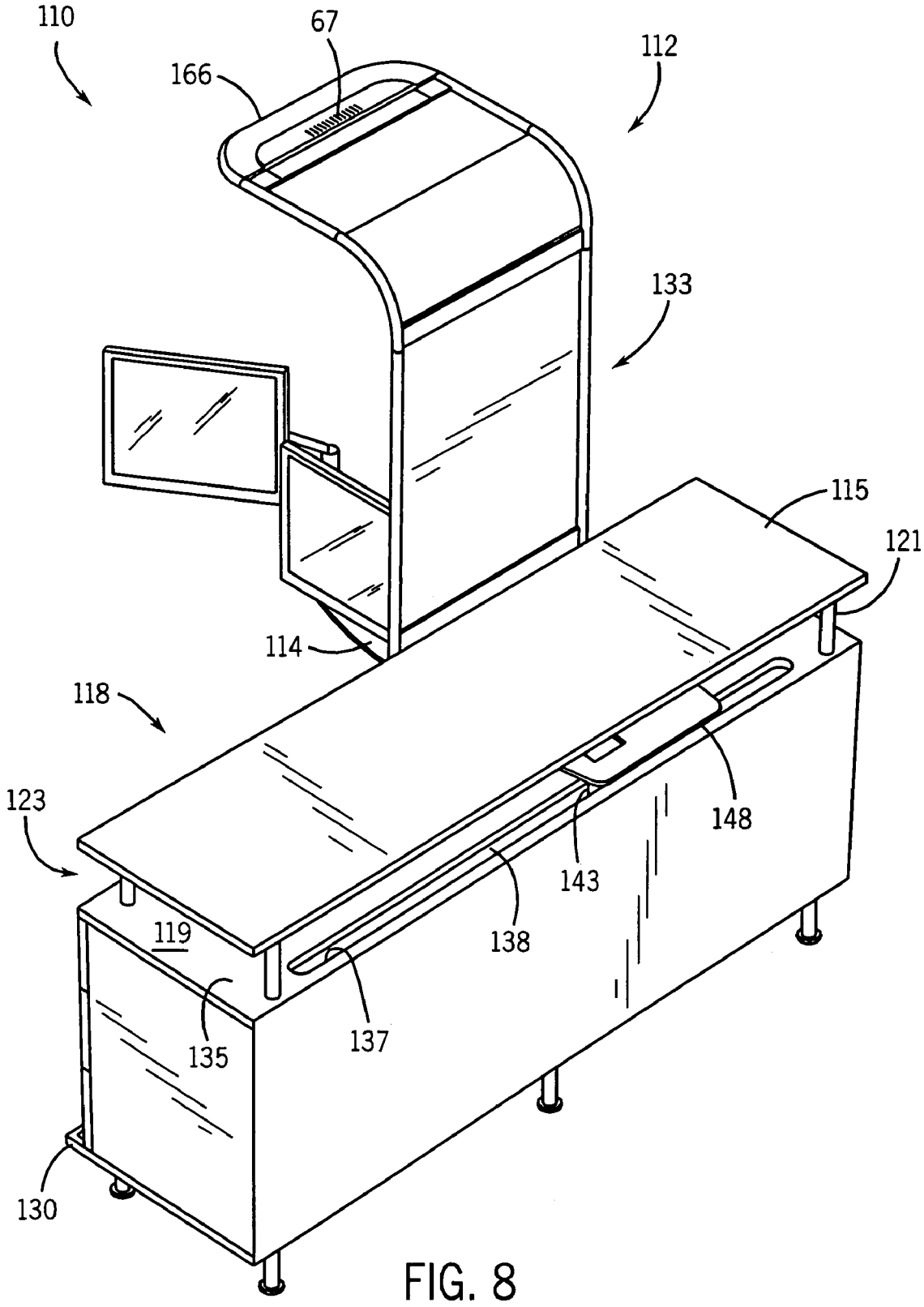

Referring to FIG. 8, a slot or space 137 providing a path or guide 138 for a support 143 (shown partially in FIG. 8) is provided within a rear section 135 of base surface 119 of base 118. Through slot or space 137, utilities (such as cables provided power, voice or data) may be passed from a source (not shown) through base 118 and into devices or apparatus within or associated with threshold 112, such as signaling light 166, task light 164, information display system 180, computing device 154, CD-ROM reader/writer 161 or other appliances (see FIG. 7).

Referring to FIGS. 9 and 10, according to an alternative embodiment, track or rail 139 is provided within a compartment 141 of base or cabinet 118. Projection 143 extending from rear portion 148 of worksurface 114 of threshold 112 includes a co-acting element (shown as a wheel or wheel bearing 145) engaging track or rail 139 installed within compartment 141 of base 118. Wheels 145 (see FIG. 10) provide support and guided movement of threshold 112 relative to base 118.

Figure 21:
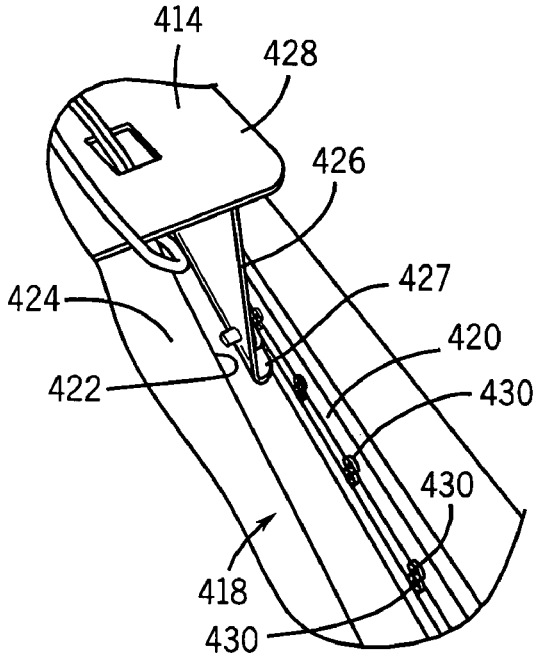
FIG. 21 is a diagram of the engagement of the movable worksurface with the base according to an alternative embodiment.

Referring to FIG. 21, a configuration of a base 418 is shown according to a particularly preferred embodiment. Base 418 provides a guide 420 installed within a slot 422 within base surface 424 for engagement of a movable apparatus such as a worksurface 414 (and/or a threshold) to allow for constrained movement relative to base 418. Guide 420 provides for engagement of co-acting elements between a projection 426 from the apparatus (shown as a rear portion 428 of worksurface 414). As shown, co-acting elements shown as wheels or wheel bearings 430 are provided on guide 420 (e.g. on a track); projection 426 of the apparatus provides flanges 427 which engage wheel bearings 430 to facilitate movement relative to base 418.

Figure 20:
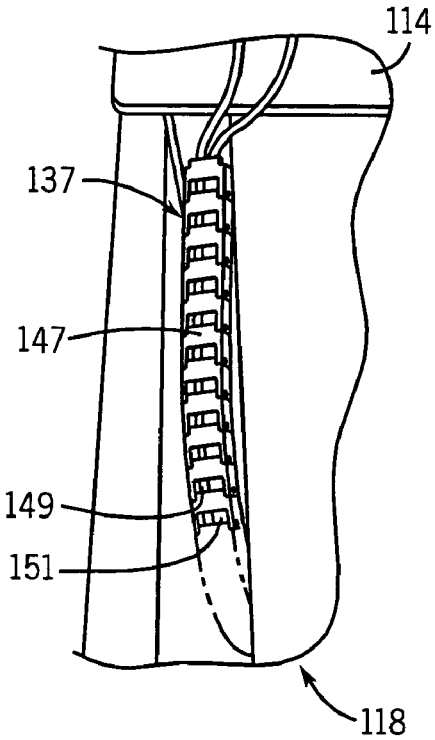
FIG. 20 is a diagram of a cable guide for the workstation according to an alternative embodiment.

Referring to FIGS. 10 and 20, a flexible cable guide 147 is provided so that passage of cables (see cables 149, 151 and 153 in FIG. 10) is facilitated. Track 147 is flexible so that movement of threshold 112 does not result in undue tangling or pulling of cables 149, 151, and 153 from their sources (not shown).

Referring to FIG. 20, a configuration of a base 118 is shown according to a particularly preferred embodiment. Base 118 has a base surface with a slot 137 into which a cable guide 147 coupled to movable worksurface 114 (shown partially) is installed. Cable guide 147 for cables 149, 151, 153 is flexible and is configured so that bending of the cables 159 within cable guide 147 is conducted in a stable and uniform manner throughout the path of travel of worksurface 114 (and the threshold, if provided) relative to base 118 (e.g. as defined by a guide (not shown) and slot 137).

Figure 11:
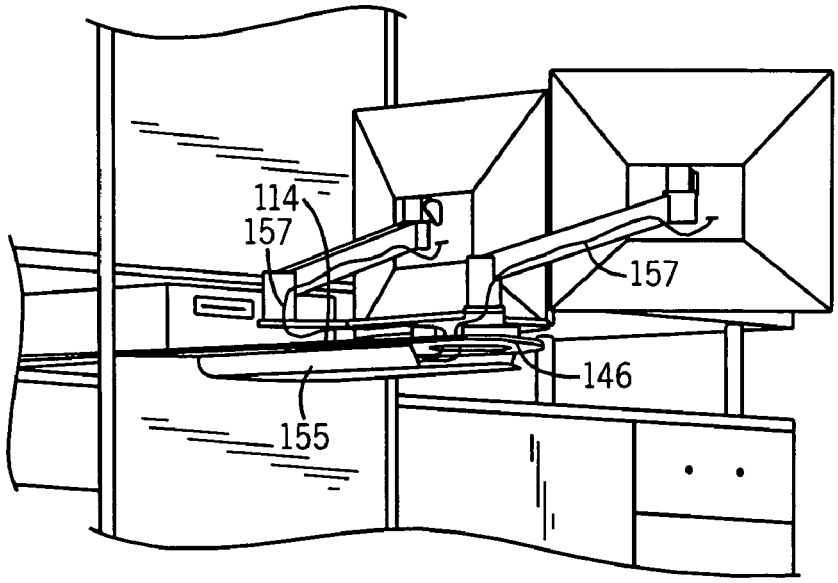
FIG. 11 is a front perspective view of the workstation according to an exemplary embodiment.

Cables or other utilities provided to the threshold may include power or data to a computing device, power or data to a signaling light, power or data to a task light and information provided to information display system (e.g. in the form of data), etc. As shown in FIG. 11, according to a particularly preferred embodiment, a cover or cable tray 155 may be installed beneath front portion 146 of worksurface 114 to support or conceal cables 157 providing power and/or data to each display device or an access point.

Figure 13:
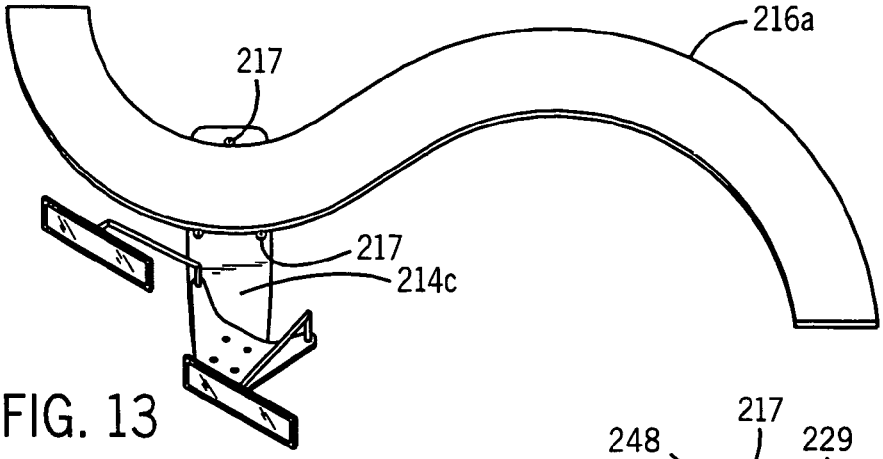
FIG. 13 is a fragmentary top perspective view of a workstation showing a non-linear path of travel for the worksurface according to an exemplary embodiment.
Figure 14A:
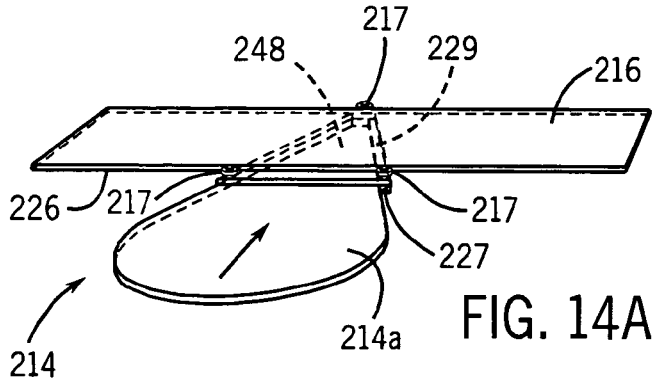
FIGS. 14A and 14B are fragmentary front perspective views of an attachment arrangement for a movable worksurface for the workstation according to exemplary embodiment.
Figure 14B:
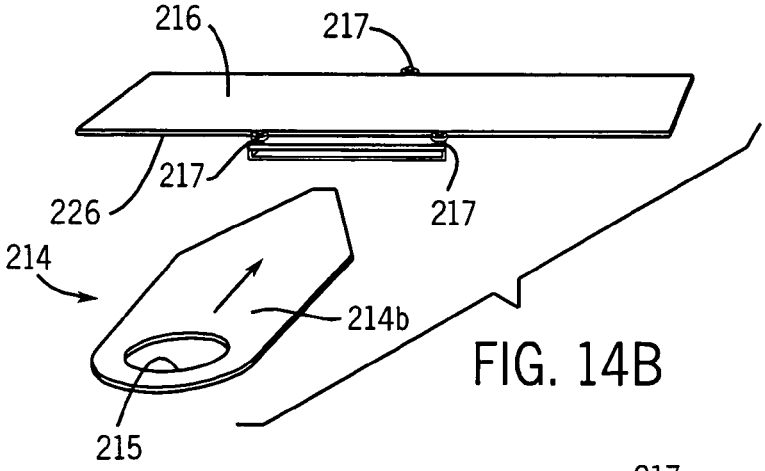
Figure 15:
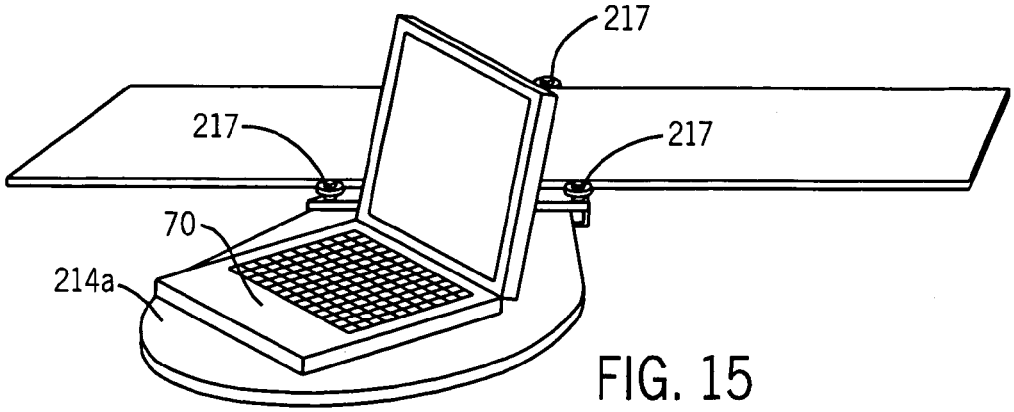
FIG. 15 is a perspective view of the arrangement shown in FIG. 14A with a computing device resting on the movable worksurface.

As shown in FIGS. 13 through 15, according to other exemplary embodiments, a movable worksurface 214 may be provided without the threshold (and may be configured to engage various other structures within the workstation). As shown in FIGS. 14A and 14B, moveable worksurfaces 214*a* and 214*b* may engage a structure such as a separator or base worksurface 216 with co-acting elements such as wheels or wheel bearings 217 (e.g. in the form of pulley wheels or other arrangements) which engage a track or guide 226 (e.g. provided along an edge or lip of separate worksurface 216). As shown specifically in FIGS. 13, 14A and 14B, base worksurface 216 or 216*a* provides for guided movement of a movable worksurface 214*a*, 214*b* or 214*c* along co-acting elements (shown as wheels upon edge of base worksurface 216 or 216*a*). According to other alternative embodiments not (shown), other arrangements providing for guided movement of a worksurface relative to a base or base worksurface may be provided.

As shown in FIG. 13, a worksurface 216*a* provided with a base or cabinet or other mounting structure (not shown) may be non-linear (e.g. curved); according to other alternative embodiments, the worksurface or path of travel of moveable worksurfaces 214*a*, 214*b*, 214*c* may be at a horizontal or at some other angular orientation or any other shape or configuration (e.g. sloping or curved or "stepped" in other planes or at other elevations along the path of travel).

Referring to FIGS. 14A and 14B, the movable worksurface may be configured to be removable from the workstation. An arrangement providing for removable and/or replaceable worksurfaces 214*a* and 214*b* which may be interchanged is shown according to a particularly preferred embodiment. Worksurfaces 214*a* and 214*b* (which may include an aperture 215 as shown in FIG. 14B that allows cords, cables, or other articles to pass through the worksurface) are configured to be inserted within a space 227 provided within a frame 229 having co-acting elements shown as wheel bearings 217; rear portion 248 of worksurface 214*a* may be installed to frame 229 (which is movable relative to the structure shown as fixed worksurface 216); a "keyed" or "interlocking" engagement may be provided to retain worksurface 214*a* within frame 229 and/or to provide sufficient structural support for load bearing.

Referring to FIGS. 16A through 18, movable worksurfaces may be provided in a wide variety of configurations and/or shapes or dimensions or materials and construction. As shown in FIGS. 16A and 16B, a generally rectangular worksurface 301 may be provided having four wheel bearings 303, or a shorter more "oval" worksurface 302 having three wheel bearings 303 may be provided. According to another alternative embodiment, a worksurface 305 may be formed as an assembly of elements as shown in FIG. 17, having an upper surface 307, a lower surface 309 and a core or central material or frame 311. As shown in FIG. 17, worksurface 305 may also be provided with an aperture 304 that allows cables, cords, or other articles to pass through worksurface 305. As shown in FIGS. 18 and 19, a worksurface assembly 313 may be formed from a frame 315 having upper horizontal arms 317 to support a panel 319, a lower support frame 321, a channel 323 (e.g. providing a pathway for cables) leading through a back plate 325 and having an aperture 327 (e.g. through which cables may be routed); panel 319 provides a worksurface. Worksurface assembly 313 may also include a circular support member 329 having an aperture 331 extending through the center of support member 329 through which cables for a device (such as display devices 68 and 69 shown in FIG. 19) resting on support member 329 may pass.

Figure 26:
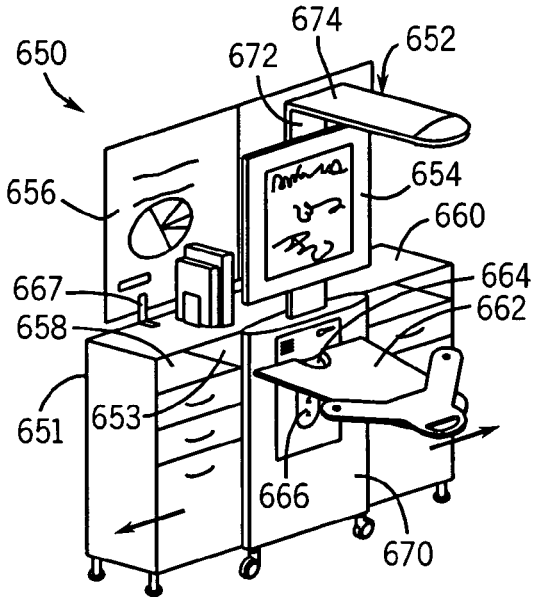

According to alternative embodiments, the various elements of the workstation may be provided (or arranged in sections or "components" that can be assembled) in a variety of different configurations. For example, as shown in FIG. 26, workstation 650 includes a threshold 652 with a lower portion 670 from which a worksurface 662 projects, and an upright structure or mast 672 providing a canopy 674 that extends in a generally horizontal plane over worksurface 662. Workstation 650 also includes display panel 654 attachable to mast 672. Each component may take one of several different embodiments, and each workstation may include any one or more of the different components. The components of the workstation may be configured for installation, in whole or in part, on articles of furniture (such as existing case goods, etc.). For example, a track or guide for the threshold may be installed on an existing base such as a credenza or storage unit.

According to other alternative embodiments (e.g. as shown in FIGS. 25 through 31), the workstation may include boards or panels intended to enhance functionality. For example, as shown in FIG. 26, workstation 650 includes a writable panel 656 and a projection screen 654. According to other exemplary embodiments (such as shown in FIGS. 25 and 27 through 31), a display board, a whiteboard, a pin or tack board, a projection screen, a privacy panel, a flat panel display, an "everywhere" display, etc., or various fixed or interchangeable combinations of any of a wide variety of panels or boards (e.g. of the types described in U.S. Pat. No. 6,263,602 entitled "Display Board System," incorporated herein by reference) may be provided with or associated with the workstation. The boards or panels may also include or provide any of a wide variety of other containers for various articles (such as other types of folders similar to folders 716 shown in FIG. 27).

Figure 25:
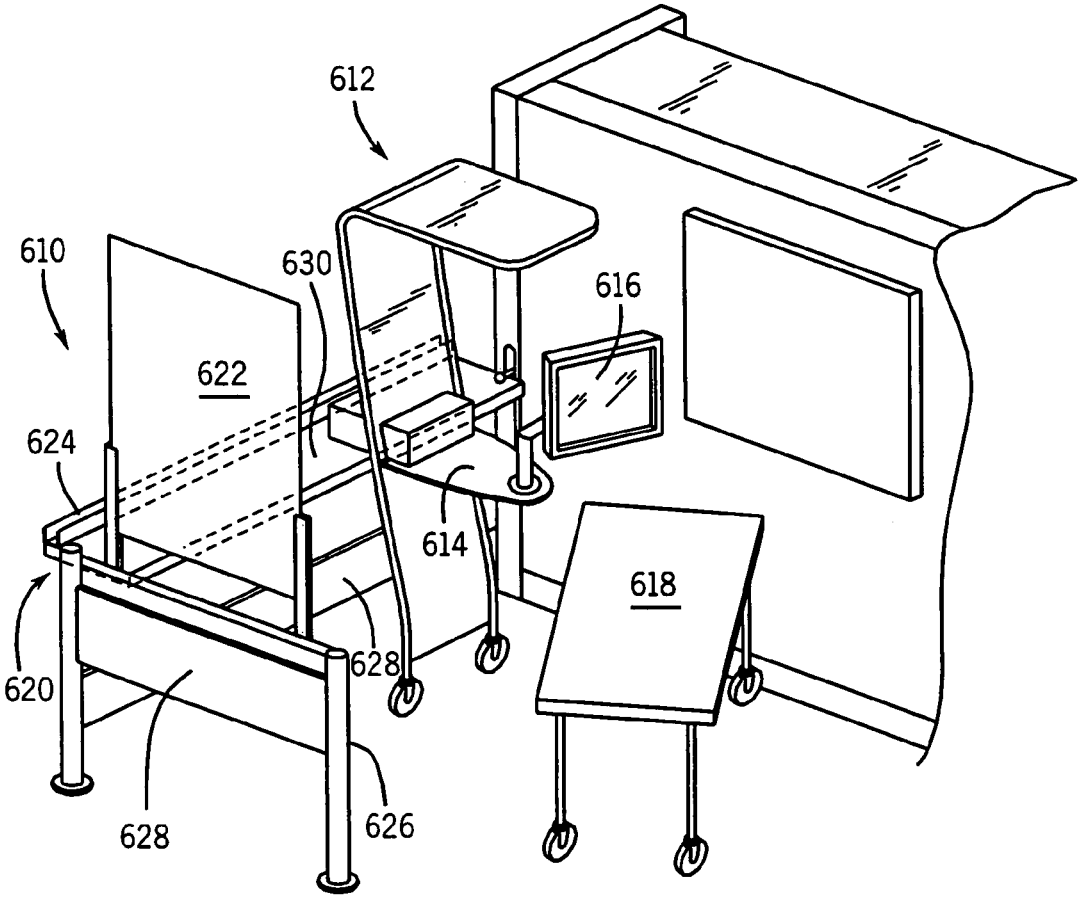
FIGS. 25 through 31 are schematic views of workstations according to alternative embodiments.

Referring to FIGS. 25 through 31, alternative embodiments of a workstation are shown. As shown in FIG. 25, a workstation 610 having other elements or articles of furniture in addition to movable threshold 612 is shown. The elements shown in workstation 610 include a mobile work table 618, a single display 616 (shown schematically to be pivotally and articulably coupled to worksurface 614 of threshold 612). Base structure 620 is shown as being constructed from posts 626 and beams 628. Base structure 620 is also shown as having a panel for a display board 622, as well as a cable tray 624 resting upon the rear portion of worksurface 630 of base 620.

According to an alternative embodiment shown in FIG. 26, a workstation 650 includes a credenza or base structure 651, a threshold 652, and a display board or panel 656. Base structure 651 is shown including a base surface 658 and a platform 660. Threshold 652 moves along the length of base structure 651 and includes a rearwardly extending portion 653 that extends between base surface 658 and platform 660. As a result of the extension of rearwardly extending portion 653 between base surface 658 and platform 660, any articles or objects (e.g. books) placed on top of base surface 658 do not interfere with the movement of threshold 652 along the length of base structure 651. Threshold 652 also includes a panel that may serve as a projection screen 654 (shown displaying a projected image), a worksurface 662, and utility access points (e.g. for power, voice, or data shown schematically as electrical outlet 666). Worksurface 662 includes an aperture shown as access 664 that allows cords or other articles to pass through worksurface 662. Panel 656 is shown schematically to be fixedly coupled to platform 660 by brackets 667.

Figure 27:
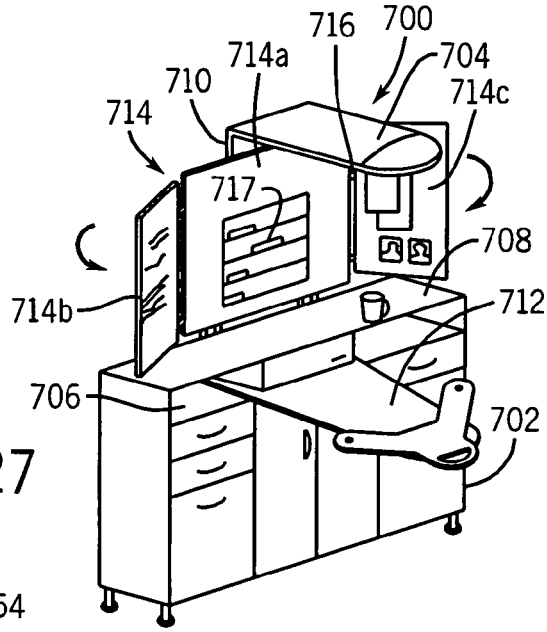

According to an alternative embodiment shown in FIG. 27, a workstation 700 includes a credenza or base structure 702 and a threshold 704. Base structure 702 is shown including a base surface 706 and a platform 708. Threshold 704 includes a frame or structure 710 located behind base structure 702 that moves along the length of base structure 702. Threshold 704 also includes a worksurface 712 that extends between base surface 706 and platform 708 into the work space: Threshold 704 includes a board or panel 714 that includes a center portion 714*a* and two side portions 714*b* and 714*c*. Center portion 714*a* is shown coupled to threshold 704. Hinges 716 (shown schematically) couple side portions 714*b* and 714*c* to center portion 714*a* and allow side portions 714*b* and 714*c* each to pivot into a storage or concealed position (i.e. where side portions 714*b* and 714*c* are pivoted toward center portion 714*a* so as to substantially cover center portion 714*a*) or a use or "display" position (i.e. where side portions 714*b* and 714*c* are pivoted away from center portion 714*a* to some or a full extent). According to alternative embodiments, each of the center portion and side portions may be selected or configured for any intended purpose or function (similar or dissimilar). As shown, center portion 714*a* includes a "container" shown as providing folders or file rack 717 for holding, organizing or storing papers or files.

Figure 28:
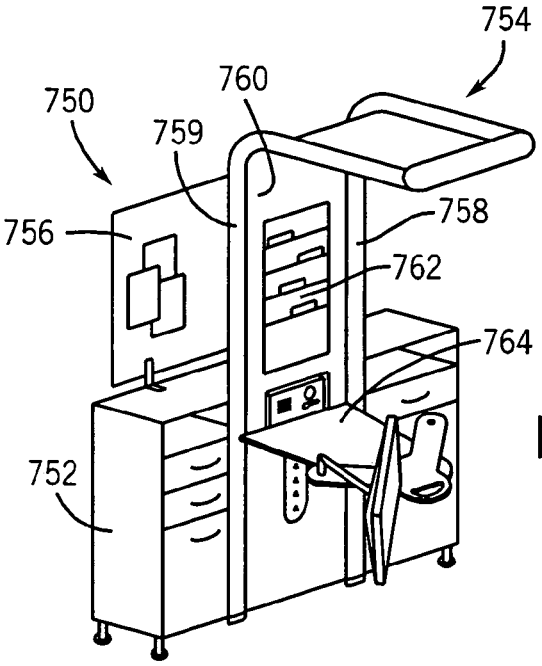

According to an alternative embodiment shown in FIG. 28, a workstation 750 includes a credenza or base structure 752, a threshold 754, and a board or panel 756. Panel 756 is shown schematically to be fixedly coupled to base structure 752. Threshold 754 includes heavier duty frame members 758 and 759 that are spaced apart a greater distance than is shown in certain other embodiments. A panel 760 is located between frame members 758 and 759. A container, shown as folders 762 (i.e. for holding, organizing, or storing papers or files), is coupled to panel 760 above a worksurface 764. Threshold 754 may slide along the floor as it moves back and forth along the length of base structure 752, or threshold 754 may be raised above the floor.

Figure 29:
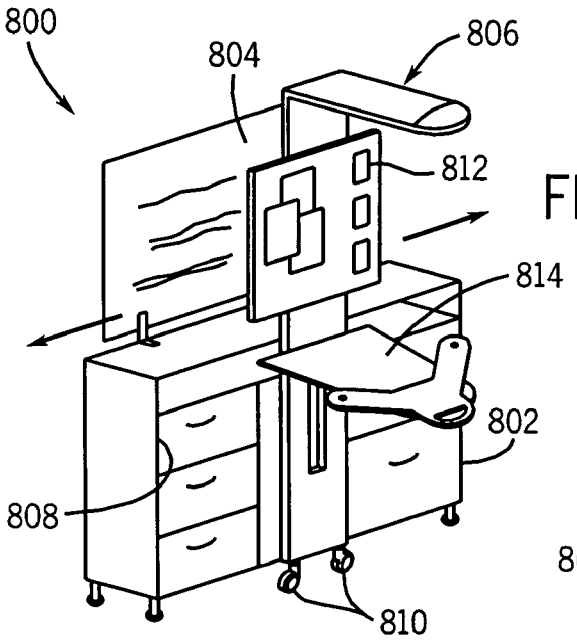

According to an alternative embodiment shown in FIG. 29, a workstation 800 includes a credenza or base structure 802, a board or panel 804, and a threshold 806. Panel 804 (shown schematically) is coupled to base structure 802. Threshold 806 is located on the front side 808 of base structure 802 and rolls on wheels shown as casters 810 on the floor along front side 808 of base structure 802. A board or panel 812 is shown coupled to threshold 806 at a location above a worksurface 814.

Figure 30:
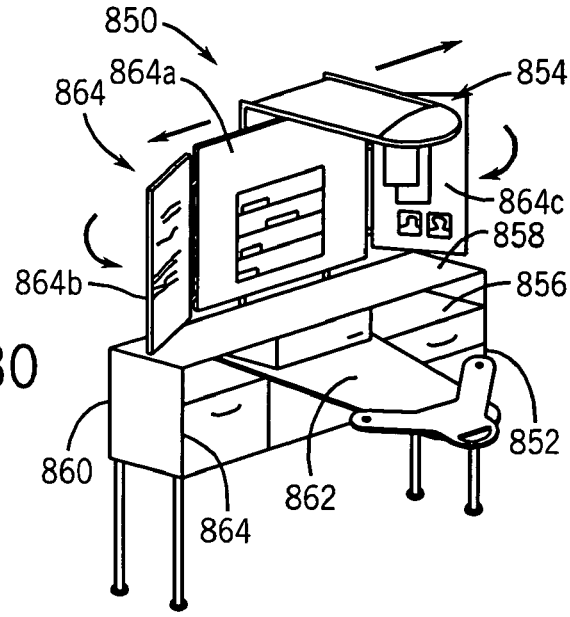

According to an alternative embodiment shown in FIG. 30, a workstation 850 includes a credenza or base structure 852 and a threshold 854 that moves back and forth along the length of base structure 852. Base structure 852 includes a base surface 856 and a platform 858 raised above base surface 856. Threshold 854 is located on a back side 860 of base structure 852 and is supported solely by base structure 852 (i.e. threshold 854 is not shown as supported by the floor). Threshold 854 includes a worksurface 862 and a board or panel 864 that is similar to board or panel 714 shown in FIG. 27. As shown, panel 864 comprises a center portion 864*a* (shown as including a display board) and side portions 864*b* and 864*c*, (each of which are shown as including pin or tack boards). Worksurface 862 is coupled to threshold 854 and extends between base surface 856 and platform 858 into the work space.

Figure 31:
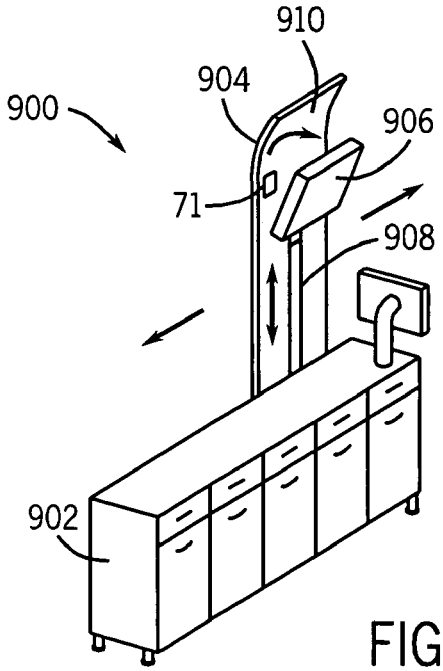

According to an alternative embodiment shown in FIG. 31, a workstation 900 includes a base structure shown as a credenza 902 and a movable threshold 904. Threshold 904 includes a vertically oriented support structure (shown as an upstanding structure) and a canopy 910 that extends upwardly and outwardly over base structure 902. A display device 906 (shown schematically as a flat panel display) is coupled to threshold 904 on a guide 908 (e.g. a track of a type shown as track 139 in FIG. 9). According to an exemplary embodiment, the guide for the display device provides a suitable set of "holding" or "locking" points or mechanisms at suitable positions along the path of travel so that the display device may be moved or be selectively adjusted in position. As shown, display device 906 may be slidably coupled to guide 908 such that the vertical position of display device 906 on threshold 904 can be adjusted and maintained. Display device is also coupled to guide 908 to allow for pivotal adjustment. According to alternative embodiments, the display device may be mounted to the threshold with an articulable arm of a type shown in FIGS. 11 and 24 and/or with one or more joints such as shown as joints 86 and 88 and 90 in FIGS. 3 and 24. Canopy 910 is oriented (e.g. angled) to provide an extended range of motion (or viewing) for display device 906 but also projects horizontally into the work space. (According to other alternative embodiments, the threshold may be provided without a canopy.) According to alternative embodiments, the workstation may include one or more boards or display panels (e.g. installed or interchangeable).

According to other exemplary embodiments, other configurations including a display board, a pin or tack board, a privacy panel, a projection screen, an active file rack, and/or a flat panel display, etc. for presenting or containing information and/or for providing a visual barrier may be included in the workstation.

According to any preferred embodiment, the apparatus (e.g. worksurface and/or threshold) can be adjusted in spatial position within a horizontal plane and in a vertical direction within the work space. In a "stowed" position, the worksurface and/or the threshold may be moved to one end of the workstation or optionally at least partially concealed within a storage unit or some other article of furniture. In any of the wide variety of "use" positions, the worksurface and/or the threshold may be deployed and located within the substantial two- (or three-) dimensional range of motion provided by the guides or rail/track system. The position and orientation of each display device may also be adjusted by manipulation of the articulable arms.

According to any preferred embodiment, each articulable arm for coupling display device(s) to the apparatus is selectively movable within a substantial range of motion. As shown, display devices shown as display panels are coupled to arms to allow suitably positioning and/or orientation for display of information in any of a variety of directions (e.g., up, down, laterally, pivotably) at each link or joint allowing articulation. The selective movement of the base and/or the worksurface and/or the display panels within a work space provides for substantial flexibility in the positioning and orientation and therefore use of the worksurface and/or one or more of the display panels within a range of motion within the work space. According to alternative embodiments, the support assembly may be configured for one information display device or two or more information display devices; the information display devices may be of any type, including flat display panels or other types of video monitors (e.g. CRT) or any other type of data or information display. The information display device may be associated with any type of appliance or device, such as a computing device or a television or network, etc.

According to any preferred embodiment, the workstation will provide enhanced functionality in comparison with such conventional arrangements, and allow the threshold and/or the worksurface to be positioned selectively to enhance privacy or openness, or generally to facilitate the work to be performed in the work space; the workstation is intended to allow the repositioning (including physical placement and orientation) of the threshold (and/or worksurface) to suit the needs of the worker. According to any preferred embodiment of the workstation, the user or users (without having to adapt or adjust their own posture and/or position) will be able to adapt the positioning and orientation of the apparatus for various and varied use or storage conditions.

According to other exemplary embodiments, the movable apparatus (e.g. threshold and/or worksurface) may be associated with other articles of furniture and/or physical structures (such as panels, partitions, or walls). It is important to note that the term "article of furniture" is intended to be a broad term and not a term of limitation. The term "article of furniture," as used in this disclosure, may include, without limitation: systems furniture (e.g., partition wall systems, architectural walls, space frames, workstations, etc.), case goods (e.g., file cabinets, storage bins, containers, closets, etc.), seating products (e.g., chairs, stools, lounges, etc.), work surfaces (e.g., tables, desk systems, credenzas, etc.), lighting systems, and other accessories.

It is important to note that the term "information" is intended to be a broad term and not a term of limitation. The term "information" may include information of any type or form or combination. It is also important to note that the terms "worksurface" and "work environment" are intended to be given broad scope and are not specifically intended as terms of limitation. It is further important to note that the construction and arrangement of the elements of the system as shown in the preferred and other exemplary embodiments is illustrative only.

Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, protocols, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A workstation defining a work space and providing at least one display device comprising:

a base providing a guide comprising a track;

at least one upstanding structure having a wheel assembly adapted for movement along a path defined by the guide about the work space to selectively deliver utilities to at least one portion of the work space; and a worksurface coupled to the structure and providing a display support assembly adapted for pivotably coupling of the display device;

wherein the structure and worksurface and display support assembly are movable relative to the base so that a display device coupled to the display support assembly may be selectively positioned for use in a variety of locations in the work space;

wherein the track is at least partially concealed within an interior region of the base.

2. The workstation of claim 1 further comprising a second track on the base providing a guide for the wheel assembly of the structure.

3. The workstation of claim 1 further comprising a horizontal rail on the base providing the guide.

4. The workstation of claim 1 further comprising a signal light on the structure.

5. The workstation of claim 4 wherein the signal light is a status indicator light to indicate a condition of the workstation.

6. The workstation of claim 1 wherein the guide comprises a track to engage wheel bearings.

7. The workstation of claim 1 wherein the worksurface includes an aperture for providing a passage for cables providing interconnectivity to utilities.

8. The workstation of claim 1 wherein the structure comprises an upstanding support structure.

9. The workstation of claim 8 wherein a display device is at least one of slidably and pivotably coupled to the support structure.

10. A workstation defining a work space and providing at least one display device comprising:

a base including a track system providing a guide, the track system comprising a first track mounted at the front of the base and a second track installed within an interior region of the base;

at least one upstanding structure having a wheel assembly adapted for movement along a path defined by the guide about the work space to selectively deliver utilities to at least one portion of the work space; and a worksurface coupled to the structure and providing a display support assembly adapted for pivotably coupling of the display device;

wherein the structure and worksurface and display support assembly are movable relative to the base so that a display device coupled to the display support assembly may be selectively positioned for use in a variety of locations in the work space.

11. The workstation of claim 10 wherein the first track comprises a horizontal platform and the wheel assembly comprises casters to roll along the horizontal platform.

12. The workstation of claim 10 further comprising sensors for at least one of lighting, temperature, humidity and sound level on the structure.

13. The workstation of claim 10 wherein the structure engages the first track and the movable worksurface engages the second track.

14. The workstation of claim 10 wherein the worksurface comprises a front portion and a rear portion and wherein the rear portion of the movable worksurface provides a projection configured to co-act with the second track installed within the base.

15. The workstation of claim 10 further comprising a cable guide adjacent the second track so that utilities may be provided to the apparatus.

16. The workstation of claim 10 wherein the base comprises a cabinet.

17. The workstation of claim 10 wherein the first track is supported on the floor.

18. The workstation of claim 10 further comprising at least one panel coupled to at least one of the base and the structure.

19. The workstation of claim 18 wherein the at least one panel is one of a white board, a tack board, a projection screen, a privacy panel, a flat panel display, a display board, and a container.

20. The workstation of claim 10 wherein the upstanding structure comprises a threshold.

21. The workstation of claim 20 wherein the threshold comprises a utility threshold.

22. A workstation defining a work space and providing at least one display device comprising:

a base providing a guide;

at least one upstanding structure comprising:

a wheel assembly adapted for movement along a path defined by the guide about the work space to selectively deliver utilities to at least one portion of the work space; and a frame system including generally vertical frame members and an overhead canopy coupled to the vertical frame members near an upper end of the vertical frame members;

a worksurface coupled to the structure and providing a display support assembly adapted for pivotably coupling of the display device;

wherein the structure and worksurface and display support assembly are movable relative to the base so that a display device coupled to the display support assembly may be selectively positioned for use in a variety of locations in the work space.

23. The workstation of claim 22 further comprising a track system to provide the guide.

24. The workstation of claim 23 wherein the structure is movable on wheels along the track system.

25. The workstation of claim 23 wherein the track system is linear.

26. The workstation of claim 23 wherein the track system is curved.

27. The workstation of claim 23 wherein the track system is horizontal.

28. The workstation of claim 22 wherein the display support assembly is configured for two display devices to be pivotally mounted.

29. The workstation of claim 22 wherein the worksurface comprises a multi-layer composite structure.

30. The workstation of claim 22 further comprising a set of handles on the structure.

31. The workstation of claim 22 wherein the overhead canopy provides a lighting device.

32. The workstation of claim 22 wherein the frame members comprise structural tubes.

33. A workstation for a work space having a floor and of a type providing a computing device with at least one display device and at least one lighting device for within the work space comprising:

a base providing at least one track system, the track system comprising a first track mounted at the front of the base and a second track installed within an interior region of the base;

a movable apparatus coupled to the at least one track system and movable relative to the base and comprising:

(a) a threshold; and (b) a worksurface;

so that the computing device and at least one display device can be supported by the worksurface and the at least one lighting device can be provided on the threshold; and wherein the movable apparatus can be selectively positioned for use in a variety of locations along the track system.

34. The workstation of claim 33 wherein the movable threshold engages the first track and the movable worksurface engages the second track.

35. The workstation of claim 33 wherein the movable worksurface comprises a front portion and a rear portion and wherein the rear portion of the movable worksurface provides a projection configured to co-act with the second track installed within the base.

36. The workstation of claim 33 further comprising a cable guide adjacent the second track so that utilities may be provided to the apparatus.

37. The workstation of claim 33 wherein the base comprises a cabinet.

38. The workstation of claim 33 wherein the first track is supported on the floor.

39. The workstation of claim 33 wherein the worksurface includes an aperture for providing a passage for cables providing interconnectivity to utilities.

40. The workstation of claim 33 further comprising at least one panel coupled to at least one of the base and the movable apparatus.

41. The workstation of claim 40 wherein the at least one panel is one of a white board, a tack board, a projection screen, a privacy panel, a flat panel display, a display board, and a container.

42. The workstation of claim 33 wherein the movable apparatus comprises an upstanding support structure.

43. The workstation of claim 42 wherein a display device is at least one of slidably and pivotably coupled to the support structure.

44. A workstation for a work space having a floor and of a type providing a computing device with at least one display device and at least one lighting device for within the work space comprising:

a base providing at least one track system;

a movable apparatus coupled to the at least one track system and movable relative to the base and comprising:

(a) a threshold comprising a frame system including generally vertical frame members and an overhead canopy coupled to the vertical frame members near an upper end of the vertical frame members; and (b) a worksurface;

so that the computing device and at least one display device can be supported by the worksurface and the at least one lighting device can be provided on the threshold; and wherein the movable apparatus can be selectively positioned for use in a variety of locations along the track system.

45. The workstation of claim 44 wherein the apparatus is movable on wheels along the track system.

46. The workstation of claim 44 further comprising a set of handles on the movable apparatus.

47. The workstation of claim 44 wherein the overhead canopy provides the lighting device.

48. The workstation of claim 44 wherein the frame members comprise structural tubes.

49. The workstation of claim 44 wherein the track system is linear.

50. The workstation of claim 44 wherein the track system is curved.

51. The workstation of claim 44 wherein the track system is horizontal.

52. A workstation for a work space of a type providing a computing device with at least one display device and at least one lighting device for use within the work space and connectivity to utilities such as power or voice or data, comprising:

a base providing at least one track system;

a movable apparatus coupled to the at least one track system and movable relative to the base and providing support for at least one of the computing device and the at least one display device or at least one lighting device, the moveable apparatus comprising a generally upright threshold and a generally horizontal worksurface, the threshold comprising a frame system including generally vertical frame members and an overhead canopy coupled to the vertical frame members near an upper end of the vertical frame members; and wherein the movable apparatus can be selectively positioned for use in a variety of locations along the track system.

53. The workstation of claim 52 wherein the base comprises a storage unit.

54. The workstation of claim 53 wherein the storage unit comprises a cabinet.

55. The workstation of claim 52 wherein the worksurface provides support for the computing device and at least one display device.

56. The workstation of claim 52 wherein the threshold is positioned directly adjacent to the base.

57. The workstation of claim 52 wherein the threshold is tilted relative to perpendicular.

58. The workstation of claim 52 wherein the threshold provides support for the at least one lighting device.

59. The workstation of claim 52 wherein the at least one lighting device comprises a signal light.

60. The workstation of claim 59 wherein the at least one lighting device comprises a task light for the work space.

61. The workstation of claim 52 wherein the movable apparatus further comprises a guide for cables providing interconnectivity to utilities.

62. The workstation of claim 52 wherein the movable apparatus comprises a set of wheels configured to engage the track system.

63. The workstation of claim 52 wherein the movable worksurface comprises a front portion and a rear portion and wherein the rear portion of the movable worksurface provides a projection configured to coact with the second track installed within the base.

64. The workstation of claim 52 further comprising a cable guide adjacent the second track so that utilities may be provided to the apparatus.

65. The workstation of claim 52 further comprising a set of handles on the movable apparatus.

66. The workstation of claim 52 wherein the overhead canopy provides the lighting device.

67. The workstation of claim 52 wherein frame members comprise structural tubes.

68. The workstation of claim 52 wherein the base comprises a cabinet.

69. The workstation of claim 52 wherein the track system comprises a first track supported on the floor.

70. The workstation of claim 52 wherein the track system is linear.

71. The workstation of claim 52 wherein the track system is curved.

72. The workstation of claim 52 wherein the track system is horizontal.

73. The workstation of claim 52 wherein the threshold comprises a generally upright structure.

74. The workstation of claim 52 wherein the threshold comprises a set of panels.

75. The workstation of claim 52 wherein the threshold comprises a platform for a computing device.

76. The workstation of claim 52 wherein the threshold comprises an overhead projection.

77. The workstation of claim 52 wherein the apparatus comprises a monitor arm.

78. The workstation of claim 52 wherein the worksurface includes an aperture for providing a passage for cables providing interconnectivity to utilities.

79. The workstation of claim 52 further comprising at least one panel coupled to at least one of the base and the movable apparatus.

80. The workstation of claim 79 wherein the at least one panel is one of a white board, a tack board, a projection screen, a privacy panel, a flat panel display, a display board, and a container.

81. The workstation of claim 52 wherein the moveable apparatus comprises an upstanding support structure.

82. The workstation of claim 81 wherein a display device is at least one of slidably and pivotably coupled to the support structure.

83. A workstation for a work space of a type providing a computing device with at least one display device and at least one lighting device for use within the work space and connectivity to utilities such as power or voice or data, comprising:

a base having a front and a top;

a track system comprising a first guide positioned at the front of the base;

a movable apparatus providing support for at least one of the computing device and the at least one lighting device, the movable apparatus comprising a generally vertical portion and a generally horizontal canopy coupled to the vertical portion and projecting into the work space; and wherein the movable apparatus is coupled to the track system and movable along the first guide at the front of the base so that the movable apparatus can be selectively positioned for use in a variety of locations within the work space.

84. The workstation of claim 83 wherein the movable apparatus comprises a threshold.

85. The workstation of claim 84 wherein the track system comprises a second guide positioned at the front of the base and the threshold is coupled to the first guide for rolling movement and to the second guide for bearing.

86. The workstation of claim 85 wherein the second guide is inset from the first guide on the front of the base so that the threshold is oriented at an acute angle relative to vertical.

87. The workstation of claim 83 wherein the movable apparatus comprises a set of frame members.

88. The workstation of claim 83 wherein the movable apparatus comprises a worksurface so that the computing device and at least one display device can be supported by the worksurface and the at least one lighting device can be provided on the movable apparatus.

89. The workstation of claim 88 wherein the worksurface includes an aperture for providing a passage for cables providing interconnectivity to utilities.

90. The workstation of claim 83 wherein the movable apparatus comprises a worksurface extending through the movable apparatus.

91. The workstation of claim 90 wherein the worksurface comprises a front portion projecting into the work space and a rear portion positioned over the base.

92. The workstation of claim 90 wherein the movable worksurface comprises a front portion and a rear portion and wherein the rear portion of the movable worksurface provides a projection configured to co-act with a portion of the track system installed within the base.

93. The workstation of claim 83 further comprising a cable guide adjacent the track system so that utilities may be provided to the apparatus.

94. The workstation of claim 83 further comprising a set of handles on the movable apparatus.

95. The workstation of claim 87 wherein the frame members comprise structural tubes.

96. The workstation of claim 95 wherein the base comprises a cabinet.

97. The workstation of claim 83 wherein the first guide is supported on the floor.

98. The workstation of claim 83 wherein the track system is linear.

99. The workstation of claim 83 wherein the track system is curved.

100. The workstation of claim 83 wherein the track system is horizontal.

101. The workstation of claim 83 wherein the movable apparatus comprises a set of wheels configured to allow rolling movement relative to the floor.

102. The workstation of claim 83 wherein the track system comprises a set of wheels.

103. The workstation of claim 83 wherein the movable apparatus further comprises a display support assembly providing for the pivotable and articulable movement of at least one display device within the work space.

104. The workstation of claim 83 further comprising a movable worksurface system that is interchangeable so that a first worksurface can be installed and then removed and a second worksurface can be installed.

105. The workstation of claim 83 further comprising at least one panel coupled to at least one of the base and the movable apparatus.

106. The workstation of claim 105 wherein the at least one panel is one of a white board, a tack board, a projection screen, a privacy panel, a flat panel display, a display board, and a container.

107. The workstation of claim 83 wherein the movable apparatus comprises an upstanding support structure.

108. The workstation of claim 107 wherein a display device is at least one of slidably and pivotably coupled to the support structure.

* * * * *